US010400378B2

(12) United States Patent
Driussi

(10) Patent No.: US 10,400,378 B2
(45) Date of Patent: Sep. 3, 2019

(54) METHOD FOR OPERATING A LAUNDRY WASHING MACHINE AND LAUNDRY WASHING MACHINE

(71) Applicant: Electrolux Appliances Aktiebolag, Stockholm (SE)

(72) Inventor: Paolo Driussi, Zoppola (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 377 days.

(21) Appl. No.: 15/501,892

(22) PCT Filed: Jul. 29, 2015

(86) PCT No.: PCT/EP2015/067366

§ 371 (c)(1),
(2) Date: Feb. 6, 2017

(87) PCT Pub. No.: WO2016/020237

PCT Pub. Date: Feb. 11, 2016

(65) Prior Publication Data

US 2017/0226680 A1 Aug. 10, 2017

(30) Foreign Application Priority Data

Aug. 6, 2014 (EP) ..... 14180055

(51) Int. Cl.
*D06F 33/02* (2006.01)
*D06F 39/00* (2006.01)
(Continued)

(52) U.S. Cl.
CPC ..... *D06F 33/02* (2013.01); *D06F 35/006* (2013.01); *D06F 39/006* (2013.01); *D06F 39/02* (2013.01);
(Continued)

(58) Field of Classification Search
CPC ..... D06F 33/02; D06F 35/006; D06F 39/006; D06F 39/02; D06F 39/087; D06F 39/088;
(Continued)

(56) References Cited

U.S. PATENT DOCUMENTS 4,777,683 A 10/1988 Pellerin
2005/0049756 A1 3/2005 Bolduan et al.

FOREIGN PATENT DOCUMENTS

DE 4122307 A1 1/1993
EP 2458062 A1 * 5/2012 ..... D06F 39/087
WO 2011067285 A1 6/2011

OTHER PUBLICATIONS

International Search Report issued in corresponding International Application No. PCT/EP2015/067366, dated Oct. 14, 2015.

* cited by examiner

*Primary Examiner* — Levon J Shahinian
*Assistant Examiner* — Tinsae B Ayalew
(74) *Attorney, Agent, or Firm* — RatnerPrestia

(57) ABSTRACT

A method for operating a laundry washing machine (100; 300) having a controllable dosing device (120; 191) suitable to supply water from an external water supply line (E) into a container (110; 172) and a metering device (125; 192) arranged between the external water supply line (E) and the container (110; 172) for determining the amount of water flowing through the dosing device (120; 191). The method measures the surplus water flowing through the dosing device (120; 191) after deactivation of the latter in a first water conveying step for conveying a first amount of water from the external water supply line (E) into the container (110; 172) and controls the supply of water in a further water conveying step taking in account the surplus water previously measured.

15 Claims, 9 Drawing Sheets

(51) Int. Cl.
*D06F 39/08* (2006.01)
*D06F 35/00* (2006.01)
*D06F 39/02* (2006.01)

(52) U.S. Cl.
CPC ..... *D06F 39/087* (2013.01); *D06F 39/088* (2013.01); *D06F 2202/08* (2013.01); *D06F 2202/085* (2013.01); *D06F 2204/086* (2013.01)

(58) Field of Classification Search
CPC ..... D06F 2202/08; D06F 2202/085; D06F 2204/086
USPC ..... 8/158
See application file for complete search history.

METHOD FOR OPERATING A LAUNDRY WASHING MACHINE AND LAUNDRY WASHING MACHINE

FIELD

The present invention relates generally to the field of laundry washing and drying, particularly to laundry washing machines, meaning with this term laundry washers and laundry washers/dryers.

Specifically, the invention relates to a method for controlling the intake of washing liquid, e.g. water, or a mixture of water and a washing agent, such as a detergent, in a laundry washing machine, and to a laundry washing machine implementing such a method.

BACKGROUND ART

Nowadays the use of laundry washing machines, both "simple" laundry washing machines (i.e. laundry washing machines which can only wash and rinse laundry) and laundry washing and drying machines (i.e. laundry washing machines which can also dry laundry), is widespread.

In the present description the term "laundry washing machine" will refer to both simple laundry washing machines and laundry washing and drying machines.

Controlling the amount of washing water supplied to a laundry washing machine is an important issue, especially nowadays that electric energy consumption and, in general, environmental responsibility are very felt.

Controlling the amount of washing water supplied is very important for example to determine the correct quantity of washing liquid for washing the clothes, wherein with washing liquid it is meant the mix of fresh washing water and detergent supplied into the washing tub where the laundry is arranged.

The washing water is preferably supplied into the washing tub through a controllable dosing device, e.g. a valve, preferably an electrovalve. In some known solutions, a metering device, for example a flowmeter, is advantageously connected to the electrovalve outlet. The electrovalve is switched on and off by a control unit, which also receives data from the flowmeter. Data from the flowmeter are detected while the valve is switched on. The amount of water introduced is calculated from data detected by the flowmeter.

The correct amount of detergent to be used in the washing liquid is based on the amount of washing water supplied, typically as a percentage of the latter and/or according to the washing cycle selected by the user.

Therefore, a wrong determination of the amount of washing water supplied into the washing tub also causes a wrong determination of the amount of detergent to be used.

This may cause the worsening of the clean effect in the washing cycle and/or the use of more washing water and/or detergent than necessary, with increased costs and negative environmental impact.

In addition, the possibility to accurately detect the amount of washing water supplied into the machine is a crucial aspect in the automatic determination of the quantity of clothes and of the type of fabric introduced in a laundry washing machine.

As known, the knowledge of the fabric type and the quantity of clothes introduced in a laundry washing machine are of a substantial importance in order to select best washing program.

Said information may be transmitted to the laundry washer control-system directly by the user, through appropriate means (such as keyboards with display, indexed knobs, keys, etc.), or can be automatically obtained by the control system itself, when the latter is technologically appropriate to this purpose (e.g. including an electronic microprocessor control system).

In the latter case, the measure of the quantity of clothes and the type of fabric can be performed either directly or indirectly.

A direct measurement method appears stricter but difficult to implement, as some sophisticated and expensive sensors are required, whereas an indirect measurement method better complies with the low-cost and moderate accuracy requirements as demanded by a commercial laundry washing machine.

Some methods of indirect measurement of the fabric type and/or the quantity of clothes introduced in a laundry washing machine are known, which are based on the software elaboration of data information being generated by proper settings of the process of water inlet inside the laundry washing machine.

Said methods are based on the physical capacity of fabrics to absorb water, according to a procedure based on their quantity and fibre type.

In particular, it is known from experimental results that a fabric type considerably affects the water initial absorption speed inside the washing tub, whereas the total quantity of water absorbed under saturation conditions is a function of both the quantity of clothes and fabric type (i.e. sponge-cloth, cotton. synthetics, silk, wool, etc.).

German patent application DE-A-4.122.307 discloses an indirect measurement method as mentioned above. According to said method, the control system of a laundry washer elaborates the data information supplied by an electromechanical level sensor (pressure switch) during the initial phases of a washing cycle; such data information relate to the water level restoring process in the washing tub of the laundry washer.

The water level restoring process requires a plurality of phases of water inlet into the washing tub. Each water inlet phase is followed by a phase of water absorption by the laundry.

During the water inlet phases, an amount of water is introduced through a valve, preferably an electrovalve, into the washing tub. A metering device, for example a flowmeter, is advantageously connected to the electrovalve outlet. The electrovalve is switched on and off by a control unit, which also receives data from the flowmeter. Data from the flowmeter are detected while the valve is switched on. The amount of water introduced during each water inlet phase and the amount of water totally introduced in the water inlet phases is calculated from data detected from the flowmeter.

However, the technique above described belonging to the known art poses some drawbacks.

A first drawback of this known technique is the fact that the valve (electrovalve) closes with a delay time with respect to the switching off signal sent by the control unit.

Due to this delay time the water continues to flow through the valve, resulting in an extra quantity of water loaded.

The control unit does not take into account this extra quantity of water. An extra quantity of water is then repeatedly introduced into the washing tub in case of a plurality of water inlet phases. The amount of water introduced during each water inlet phase and the amount of water totally introduced in the water inlet phases is therefore not correctly calculated.

The same problems arise when water inlet phases are used in laundry washing machines equipped with a water softening device. In this case the water is supplied to a regeneration-agent reservoir.

In the techniques of known art, therefore, the real amount of water introduced in the washing tub is not accurately detected and/or calculated. This negatively affects different steps of the washing cycle: the step of determining the proper quantity of detergent to be added to the washing water; and/or the step of determining the heating time of the washing liquid, i.e. water and detergent, during the washing phase; and/or the step of determining the quantity of clothes and/or the type of fabric introduced in the laundry washing machine. In case the laundry washing machines are equipped with a water softening device, this can also negatively affect the step of supplying water to the regeneration-agent reservoir.

The object of the present invention is therefore to overcome the drawbacks posed by the known technique.

It is a first object of the invention to implement a method for operating a laundry washing machine that makes it possible to properly control the amount of water supplied to the washing machine.

It is an object of the invention in particular to implement a method that makes it possible to control the exact amount of washing water supplied to the washing machine.

It is another object of the invention to implement a method that makes it possible to proper determining the quantity of clothes and/or the type of fabric introduced in the laundry washing machine.

It is a further object of the invention to implement a method that allows determining the proper quantity of detergent to be added to the washing water.

It is another object of the invention to implement a method that allows determining the proper heating time of the washing liquid, i.e. water and detergent, during the washing phase.

It is a further object of the invention in particular to implement a method that makes it possible to control the correct amount of water supplied to a water softening device, in particular to a regeneration-agent reservoir of the latter, of the laundry washing machine.

Advantages, objects, and features of the invention will be set forth in part in the description and drawings which follow and in part will become apparent to those having ordinary skill in the art upon examination of the following or may be learned from practice of the invention.

SUMMARY OF SELECTED INVENTIVE ASPECTS

Applicant has found that by measuring the surplus water flowing through a dosing device after deactivation of the latter in a first water conveying step for conveying a first amount of water from an external water supply line into a washing machine, and by controlling the supply of water in a further water conveying step taking in account this surplus water, it is possible to properly control the amount of water supplied to the washing machine.

In a first aspect thereof the present invention relates, therefore, to a method for operating a laundry washing machine, said laundry washing machine comprising:

- a washing tub external to a washing drum suited to receive laundry;
- a control unit;
- a water load system suitable to supply water from an external water supply line into a container of said laundry washing machine, said water load system comprising:
  - a controllable dosing device arranged between said external water supply line and said container and which is activated and deactivated for conveying therethrough an amount of water from said external water supply line to said container;
  - a metering device arranged between said external water supply line and said container for determining the amount of water flowing through said dosing device;

said method comprising:

- a first water conveying step for conveying a first amount of water from said external water supply line through activation and deactivation of said dosing device; wherein the method comprises:
- a control step of determining, by means of said metering device, the surplus water flowing through said dosing device after said deactivation of said dosing device in said first water conveying step;
- at least a further water conveying step for conveying a further amount of water from said external water supply line to said container through activation and deactivation of said dosing device, wherein activation and deactivation of said dosing device in said at least a further water conveying step depends on the amount of said surplus water determined in said control step.

In a preferred embodiment of the invention, the activation and deactivation of the dosing device in the at least a further water conveying step comprises the step of activating the dosing device for an activation time, wherein the activation time depends on the amount of the surplus water determined in the control step.

Preferably, in this case, the activation time is obtained by subtracting an adjustment time value based on the amount of the surplus water from a theoretical activation time, wherein the theoretical activation time is the activation time of the dosing device for conveying a further amount of water from the external water supply line to the container.

In an alternative preferred embodiment of the invention, the activation and deactivation of the dosing device in the at least a further water conveying step comprises the step of activating the dosing device by controlling the amount of water flowing therethrough by means of the metering device, wherein the step of controlling the amount of water depends on the amount of the surplus water determined in the control step.

Preferably, in this case, the phase of activating the dosing device by controlling the amount of water flowing therethrough by means of the metering device is carried out by subtracting an adjustment amount of water value based on the amount of the surplus water from a theoretical amount of water, wherein the theoretical amount of water is the amount of water flowing through the dosing device for conveying a further amount of water from the external water supply line to the container.

In a preferred embodiment of the invention, the method comprises a plurality of further water conveying steps.

Preferably, activation and deactivation of the dosing device in the further water conveying steps depends on the amount of the surplus water determined in the control step.

In a further preferred embodiment of the invention, the method further comprises a plurality of further control steps of determining, by means of the metering device, the surplus water flowing through the dosing device after each deactivation of the dosing device in the plurality of further water conveying steps.

Advantageously, activation and deactivation of the dosing device in one of the further water conveying steps depends on the amount of the surplus water determined in a control step carried out after a preceding water conveying step.

According to a preferred embodiment of the invention, the control step of determining, by means of the metering device, the surplus water flowing through the dosing device is carried out for a predetermined time interval after deactivation of the dosing device.

Preferably, the step of determining water flowing through said dosing device by means of said metering device comprises the detection of the amount of water measured by the said metering device or comprises elaboration of a signal generated by said metering device. Opportunely, such elaboration is carried out by the control unit.

In a preferred embodiment of the invention, the container of said laundry washing machine coincides with the washing tub.

In this case, preferably, the first water conveying step and/or said at least a further water conveying step are steps of conveying water into the washing tub for wetting the laundry. Preferably, the steps of conveying water into the washing tub for wetting the laundry are carried out at the beginning of the washing cycle In a further preferred embodiment of the invention, the container of the laundry washing machine is a regeneration-agent reservoir of a water softening device of the laundry washing machine.

In this case, preferably, the first water conveying step and/or said at least a further water conveying step are steps of conveying water into the regeneration-agent reservoir for regenerating agent into the regeneration-agent reservoir.

In a preferred embodiment of the invention, during the first water conveying step, the first amount of water is conveyed from the external water supply line to the container.

In such a case, preferably, after said first water conveying step, the method comprises a step of determining the first amount of water flowing through the dosing device from the activation to the deactivation of the dosing device by means of the metering device;

In an alternative preferred embodiment of the invention, during the first water conveying step, the first amount of water is conveyed from the external water supply line to the outside or to an auxiliary container.

Preferably, the method further comprises a phase of determining/evaluating the load of the laundry on the base of the amount of water determined by means of the metering device and flowing through the dosing device during the first water conveying step and/or the at least a further water conveying step.

Preferably, the method further comprises a phase of determining/evaluating the amount of a detergent for washing the laundry on the base of the amount of water determined by means of the metering device and flowing through the dosing device during the first water conveying step and/or the at least a further water conveying step.

Preferably, the method further comprises a phase of determining/evaluating the heating time of the washing liquid inside said washing tub on the base of the amount of water determined by means of the metering device and flowing through the dosing device during the first water conveying step and/or the at least a further water conveying step.

Preferably, the controllable dosing device comprises a valve, more preferably an electrovalve.

Preferably, the metering device comprises a flowmeter.

In a second aspect thereof, the present invention concerns a laundry washing machine suited to implement the method of the invention described above.

Preferably, the laundry washing machine further comprises a water softening device.

BRIEF DESCRIPTION OF THE DRAWINGS

Further characteristics and advantages of the present invention will be highlighted in greater detail in the following detailed description of some of its preferred embodiments, provided with reference to the enclosed drawings. In the drawings, corresponding characteristics and/or components are identified by the same reference numbers. In particular.

DETAILED DESCRIPTION OF EXAMPLE EMBODIMENTS

The method of the present invention has proved to be particularly advantageous when applied to laundry washing machines, as described below. It should in any case be underlined that the present invention is not limited to this type of application. On the contrary, the present invention can be conveniently applied to other laundry treating appliances, like for example laundry washing and drying machines, wherein one or more steps of introducing water is required.

Figure 1:
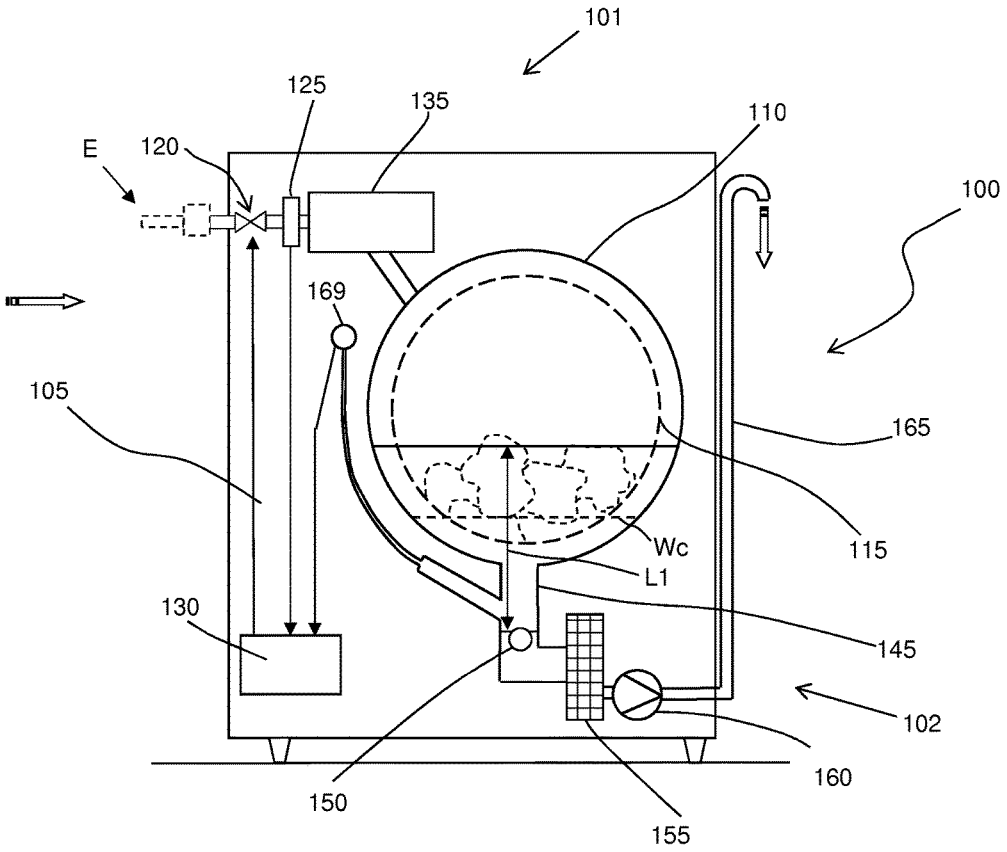
FIG. 1 shows a front view of a laundry washing machine implementing the method according to the invention.

With reference to FIG. 1, a laundry washing machine 100 according to the invention is described, in which a method according to a first embodiment of the invention is implemented. The laundry washing machine 100 comprises a cabinet 105 enclosing a washing tub 110 and, rotatably accommodated therein, a laundry drum 115, for containing the laundry to be washed. The laundry washing machine 100 has a water load system 101 and a waste washing liquid discharge system 102. The water load system 101 preferably comprises a first dosing device, preferably a first electrovalve 120, whose inlet is connectable (for example via a hose) to an external water supply line E. In some embodiments of the invention, the laundry washing machine may be equipped with a dosing device adapted for allowing selectively providing, at its outlet, cold water or hot water; for example this different dosing device may comprise two electrovalves, one advantageously connectable to a cold water socket and the other advantageously connectable to a hot water socket, or an electrovalve with only one outlet and two inlets one advantageously connectable to a cold water socket and the other advantageously connectable to a hot water socket.

A first metering device, preferably a first flowmeter 125, is connected to the dosing device 120 outlet. In different preferred embodiments, the metering device may be connected upstream of the dosing device.

The first metering device 125 detects the quantity of liquid, water in the embodiment here illustrated, that flows through it and generates a signal indicative of the amount of liquid flowing over the time. According to the type of metering device utilized, the signal shape generated by the metering device 125 may be different. For example, said signal may be proportional to the amount of liquid flown in a period of time or, preferably, said signal may be a pulse signal over the time, wherein each pulse is generated when a pre-fixed quantity of water has flown therethrough. Functioning of a flowmeter of this type will be described in more detail in the following.

The first electrovalve 120 is preferably controlled by a control unit 130. The control unit 130 also receives the signal generated by the first flowmeter 125.

The loaded water through the water load system 101 is preferably made to pass through a detergent dispensing assembly 135, preferably a container of detergents 135, and then supplied to the washing tub 110, thus creating a washing liquid which is a mix of water and detergent. In a further advantageous embodiment, the metering device may be preferably connected to the container 135 outlet. In this case the metering device detects the quantity of washing liquid flowing therethrough. Advantageously, a by-pass circuit may be provided, internally or externally to the container 135, adapted for allowing the loaded water to be adducted to the washing tub 110 directly, i.e. without being mixed with one or more detergents contained in the container 135.

The washing liquid discharge system 102 preferably comprises a discharge duct 145, for example at the bottom of the washing tub 110, preferably closable by a valve 150; downstream the valve 150, an anti-fluff/anti-clog filter 155 is preferably provided, upstream a discharge pump 160 whose outlet is connected to a discharge hose 165, preferably connectable to a drain socket (not shown). A pressure sensor 169 (which may be a pressure switch) is advantageously provided, adapted to sense the pressure of the washing liquid present in the washing tub 110 and to provide the measure to the control unit 130.

The washing liquid which lies in the washing tub 110 will be indicated hereinafter as "free liquid" or "free water"

Figure 2:
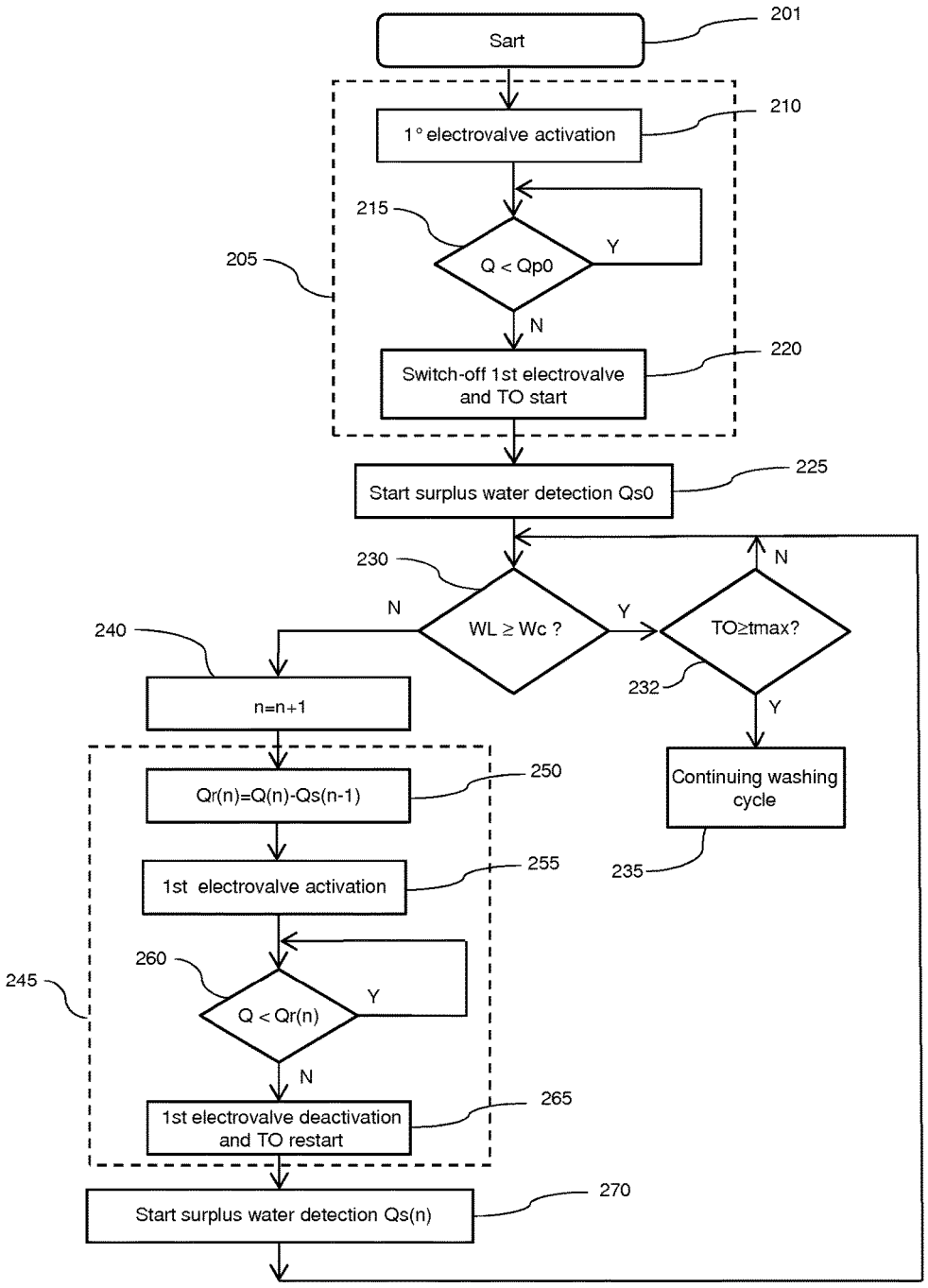
FIG. 2 is a simplified flow chart of the basic operations of a method for operating the washing machine of FIG. 1 according to a first preferred embodiment of the invention.
Figure 3:
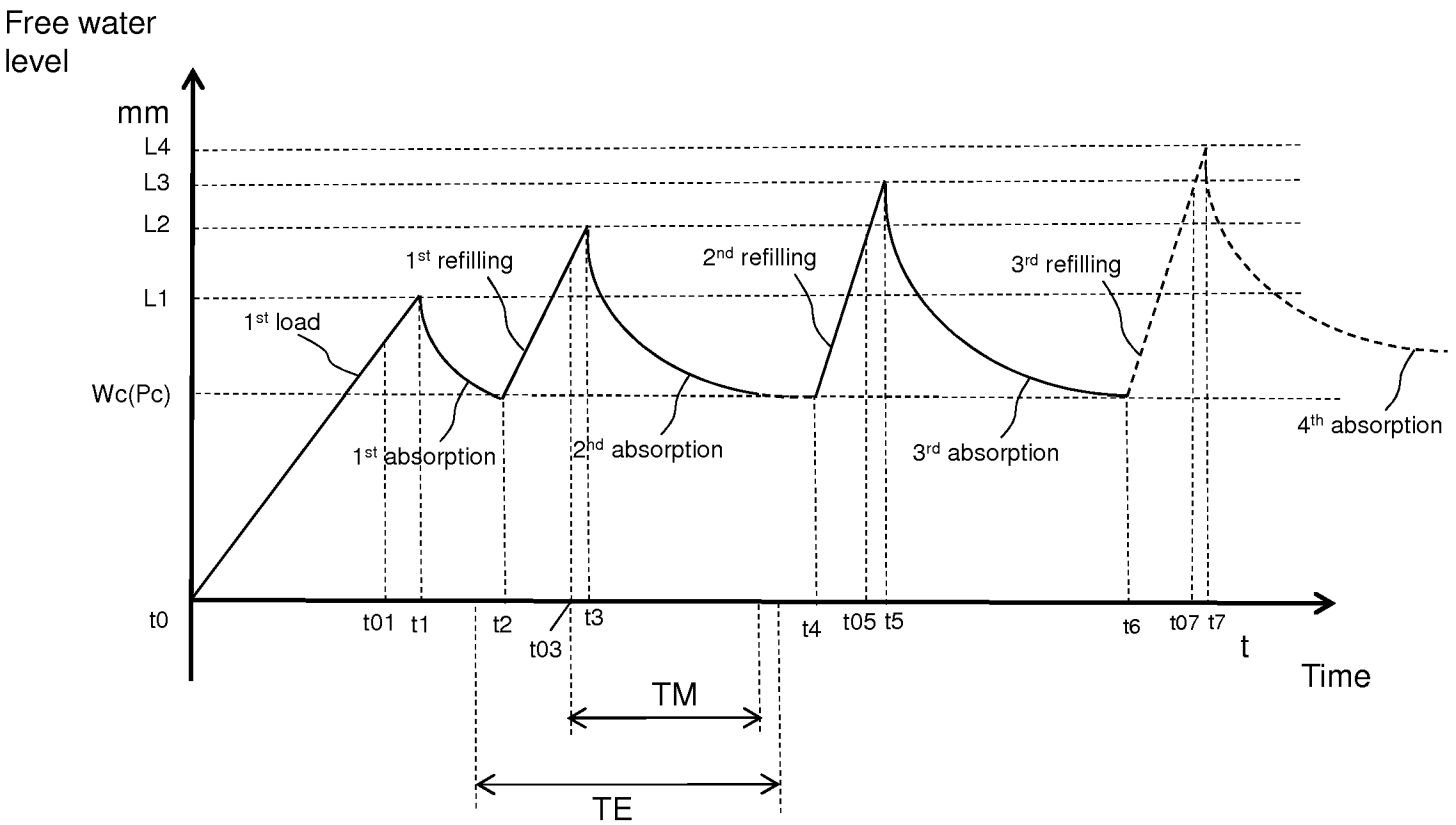
FIG. 3 illustrates a schematic diagram of the free water level in the washing tub as a function of the time according a preferred embodiment of the present invention.

FIG. 2 illustrates in terms of blocks some steps of a method according to an embodiment of the present invention. FIG. 3 is an exemplary diagram showing the theoretical evolution of the level of free water WL (which may be expressed in millimeters and preferably detected by the pressure sensor 169) in the washing tub 110 as a function of the time in laundry machine 100 during the execution of the method of FIG. 2.

The preferred embodiment of the method here described refers in particular to a sequence of partial loads of water into the washing tub 110. Each partial load provides for loading a corresponding water amount in the washing tub 110. The loads of water are preferably carried out at the beginning of a washing cycle and relates to the phase of the washing cycle where the laundry is being wetted and/or completely drenched. In the preferred embodiment here described, it is assumed that at the beginning of the cycle the laundry load is already known. In a preferred embodiment, the amount of load may be selected by the user through an interface button or selector (for example a "half laundry load" may be selected by the user, which may correspond, for example, to a laundry load of about 4 Kg).

Furthermore, in the preferred embodiment of the invention during one or more of said water loads, the loaded water is made to pass through the container of detergents 135 thus preferably supplying washing liquid (water and detergent) to the washing tub 110.

The method starts at 201. At the beginning, a load of a preliminary fixed amount of water Qp0 into the washing tub 110 (e.g. 6 liters) is performed (block 205); the preliminary fixed amount of water Qp0 to be loaded is preferably a minimum amount of water that would be sufficient for wetting a half laundry load (e.g. 6 liters for a laundry load around 4 kg).

The load of a preliminary fixed amount of water Qp0 (block 205) is carried out by opening the first electrovalve 120. In particular, the loading step (block 205) may advantageously firstly comprise the electrovalve activation at time t0 (block 210) by sending a switch-on signal from the control unit 130. The water load is controlled by means of the first flowmeter 125 (block 215). When the quantity Q of water detected by the first flowmeter 125 reaches the preliminary fixed amount of water Qp0 at a first time t01 (exit branch "N" of block 215), the first electrovalve 120 is deactivated (block 220) by sending a switch-off signal from the control unit 130.

At the same time a time out timer TO starts to count.

At this point, and according to an aspect of the invention, the first flowmeter 125 still continues to detect the water which passes through it (block 225). This means that the first flowmeter 125 detects and/or measures the quantity of water Qs0 which exceeds the preliminary fixed amount of water Qp0 and which is loaded into the washing tub 110, hereinafter indicated as "surplus water" Qs0.

The surplus water Qs0 is caused by the delay time of the first electrovalve 120 to close, with respect to the time (t01) of the switching-off signal sent by the control unit 130, at a time which correspond to time t01 plus a delay time (Delta time).

Due to this delay time (Delta time), in fact, the water continues to flow through the first electrovalve 120 and the first flowmeter 125. Eventually, the real quantity of water Qr0 loaded into the washing tub 110 is higher than the preliminary fixed amount of water Qp0, i.e. Qr0=Qp0+Qs0.

It has to be noted that the quantity of surplus water Qs0 depends, further to the switching-off delay time of the first electrovalve 120, also on the pressure of the water coming from the external water supply line E, which may typically vary over time.

The value of surplus water Qs0 is preferably stored in a memory table of the control unit 130.

It has to be noted that the values sent from the first flowmeter 125 to the control unit may represent the real amount of water detected by the first flowmeter 125 or may represent a signal indicative of such a water. In the latter case, the real amount of water is preferably calculated by the control unit 130, as will be better described later with reference to the description of a preferred embodiment of flowmeter usable in the washing machine 100.

After the first electrovalve 120 is deactivated (block 220), substantially at time t01, the level WL of free water present in the washing tub 110 still increases due to said delay time of the first electrovalve 120 to close and the level WL reaches a first level L1, substantially at a time t1 slightly greater than the de-activation time t01 (as illustrated in FIGS. 1 and 3).

Then from time t01 on, i.e. after the first electrovalve 120 is deactivated, and within a maximum time tmax, the free water level WL is monitored (block 230 and block 232).

In fact, during the subsequent time (t>t1), there will be a first water absorption by the laundry, causing the water level WL to decrease. Actually, water absorption can start already before t1, i.e. before the end of the water admission in the washing tub 110, since water starts being absorbed by laundry as soon as it contact the latter; anyway, in FIG. 3 it has been schematically illustrated an ideal situation, in which laundry starts absorbing water only after each step of water loading has been concluded.

From time t01 on, the pressure in the washing tub 110, advantageously measured by the pressure switch 169, is monitored; the measured pressure provides an indication of the level WL of free water present in the washing tub 110. The measured pressure is advantageously converted into a measure of the level WL of free water in the washing tub 110, which is compared to a predetermined minimum level Wc (for example, a level of 30 mm). In a further embodiment the measured pressure is compared to a predetermined minimum pressure level Pc (i.e., the pressures are not converted in levels of free water). According to a still further embodiment of the present invention, instead of monitoring the pressure in the washing tub 110, the level WL of free water is directly measured, for example by an optical device or a level sensor, and it is compared to the predetermined minimum level Wc.

The amount of water absorbed by the laundry and the speed of the absorption strongly depend on the amount (clearly a greater amount of laundry absorbs more water that a smaller amount of the same type of laundry) and on the type of the laundry (for example if the laundry is made of cotton it absorbs more water that if it would be made of synthetic fibres) located in the laundry drum 115. Another cause of variation in the level of free water WL is the rotation of the laundry drum 115: with the rotation of the laundry drum 115, the laundry is squeezed and a portion of the water previously absorbed by the laundry is released in the washing tub 110, going to increase the level of free water. Another possible cause of variation in the level of free water WL is the activation of a recirculation system (not illustrated, preferably provided with a recirculation pump and some recirculation conduits, all not illustrated), which can be advantageously provided in order to take some washing liquid from a bottom region of washing tub 110 and to re-admit it in an higher region of the washing tub 110.

If the measured level WL of free water is higher than or equal to the minimum level Wc (exit branch "Y" of block 230), or as long as the measured pressure is higher than or equal to the minimum pressure level Pc, and if the time out timer TO has reached a maximum time out value tmax (exit branch "Y" of block 232), the control unit 130 assesses that the amount of water Qr0 that has been previously loaded in the washing tub 110 is sufficient to guarantee a correct washing of the laundry; in this case, the load of water is considered to be completed, and the washing cycle may continue with the following steps (block 235), e.g. heating, draining, bleaching, spinning, etc.

Conversely (exit branch "N" of block 230), if the measured level WL of free water falls below the minimum level Wc, or if the measured pressure falls below the minimum pressure level Pc, the control unit 130 assesses that the amount of water that has been loaded until now into the washing tub 110 is not sufficient to guarantee a correct washing of the laundry, and further loads of water into the washing tub 110 should be performed (water refilling phases). In the preferred embodiment here described, each of the further water refilling phases consists of a load of a prefixed amount of refilling water Q(n), for example 0.5 liter. In different embodiments, nevertheless, the amount of refilling water may vary according to preferred ad hoc criteria.

In a successive step (block 240), a refill counter n is incremented. The refill counter n is advantageously set to zero at the beginning of the washing cycle, for example at block 201.

Then, a water refilling phase is performed (block 245). The water refilling phase (block 245) firstly provides for the calculation (block 250) of the real amount of water Qr(n) that has to be conveyed into the washing tub 110. The calculation (block 250) takes into account of the surplus water Qs(n−1) that was loaded into the washing tub 110 in a previous water load. The real amount of water Qr(n) is therefore calculated as the difference between the prefixed amount of refilling water Q(n) and the surplus water Qs(n−1) of the previous water load, i.e. Qr(n)=Q(n)−Qs(n−1).

If the refill counter n is equal to 1, i.e. when the water refilling is performed for the first time, the surplus water Qs0 is the surplus water that was conveyed into the washing tub 110 after loading the preliminary fixed amount of water Qp0.

If the refill counter n is higher than 2, i.e. when at least one water refilling phase has been already performed, the surplus water Qs(n−1) is the surplus water that was conveyed into the washing tub 110 after the previous water refilling phase.

After the calculation step (block 250), the real amount of water Qr(n) is conveyed into the washing tub 110 by opening the first electrovalve 120 (block 255). In particular, the first electrovalve 120 is activated (for example at time t2 or t4 or t6 in FIG. 3) by sending a switch-on signal from the control unit 130.

The water load Q is controlled by means of the first flowmeter 125 (block 260).

When the quantity of water Q detected by the first flowmeter 125 reaches the real amount of water Qr(n) (exit branch "N" of block 260), the first electrovalve 120 is deactivated (block 265) by sending a switch-off signal from the control unit 130 (for example at time t03 or t05 or t07 in FIG. 3).

At the same time the time out timer TO is reset and starts to count.

At this point, and according to the relevant aspect of the invention, the first flowmeter 125 still continues to detect the water which passes through it (block 270). This means that the first flowmeter 125 detects and/or measures the quantity of water Qs(n) which exceeds the real amount of water Qr(n) and which is loaded into the washing tub 110, i.e. the surplus water Qs(n). The surplus water Qs(n), for the same reasons stated above, is caused by the delay time of the first electrovalve 120 to close with respect to the time (t03 or t05 or t07) of the switching-off signal sent by the control unit 130. Due to this delay time, in fact, the water continues to flow through the first electrovalve 120 and the first flowmeter 125. Eventually, the quantity Qw(n) of refilling water loaded into the washing tub 110 during a water refilling phase is higher than the real amount of water Qr(n) previously calculated, i.e. Qw(n)=Qr(n)+Qs(n).

Preferably, the quantity Qw(n) of refilling water loaded into the washing tub 110 is equal, or substantially equal, to the quantity of 0.5 liter desired.

The value of surplus water Qs(n) is preferably stored in a memory table of the control unit 130.

At this point, the method re-enters the check loop (returning to block 230).

In fact, at the end of a water refilling phase, substantially at time t3 or t5 or t7, the level of free water present in the washing tub 110 reaches a new level (L2 or L3 or L4).

Times t3, t5 and t7, are slightly greater than the respective de-activation times t03, t05 and t07 (as illustrated in FIGS. 1 and 3).

During the subsequent time (t>t3 or t>t5 or t>t7), there will be a further water absorption by the laundry, causing the water level WL to decrease. Also in this case FIG. 3 shows only an ideal situation, in which laundry starts absorbing water only after each step of water loading has been concluded, but in practice it can happen that water starts being absorbed also during its supplying, in which case water level start decreasing already before respectively t3, t5, t7.

From time t03 or t05 or t07 on and within a maximum time tmax, the pressure in the washing tub 110, advantageously measured by the pressure switch 169, is monitored (as explained above); the measured pressure provides an indication of the level of free water WL present in the washing tub 110. The measured pressure is advantageously converted into a measure of the level of free water WL in the washing tub 110, which is compared to the predetermined minimum level Wc. The method will proceed, as described above, with one or more further water refilling phase (block 245), if necessary.

As exemplary illustrated in FIG. 3, and according to the method of the present invention above described, water load phases (t0÷t1, t2÷t3, t4÷t5, t6÷t7) are followed (or partially superimposed) by water absorption phases (t1÷t2, t3÷t4, t5÷t6, t>t7). The duration of said water absorption phases gives an indication of the water absorption capacity by the laundry and therefore an indication of the type of laundry (for example by comparing the duration of the water absorption phases with experimental data stored in the control unit 130). In preferred embodiments of the invention, this may be used to estimate the real load of the laundry (for example in terms of kg), and/or the type of laundry (e.g. cotton, silk, etc.).

Preferably, detection of the surplus water Qs(n) (block 225 and block 270) according to an aspect of the invention is carried out for a prefixed monitoring time interval TM (for example 5 sec) from the starting time of the detection, i.e. the time (t01 or t03 or t05 or t07) of the switching-off signal sent by the control unit 130. In different embodiments, nevertheless, detection of the surplus of water Qs(n) (block 225 and block 270) may be carried out for a variable time interval. In a further different embodiment, preferably, detection of the surplus of water Qs(n) may be carried out from the starting time of the detection, i.e. the time (t01 or t03 or t05 or t07) of the switching-off signal sent by the control unit 130, until the new activation of the first electrovalve 120 in the subsequent water refilling phase, or also until the flowmeter does not detect any further passage of water (i.e. the electrovalve 120 is actually closed).

Figure 4:
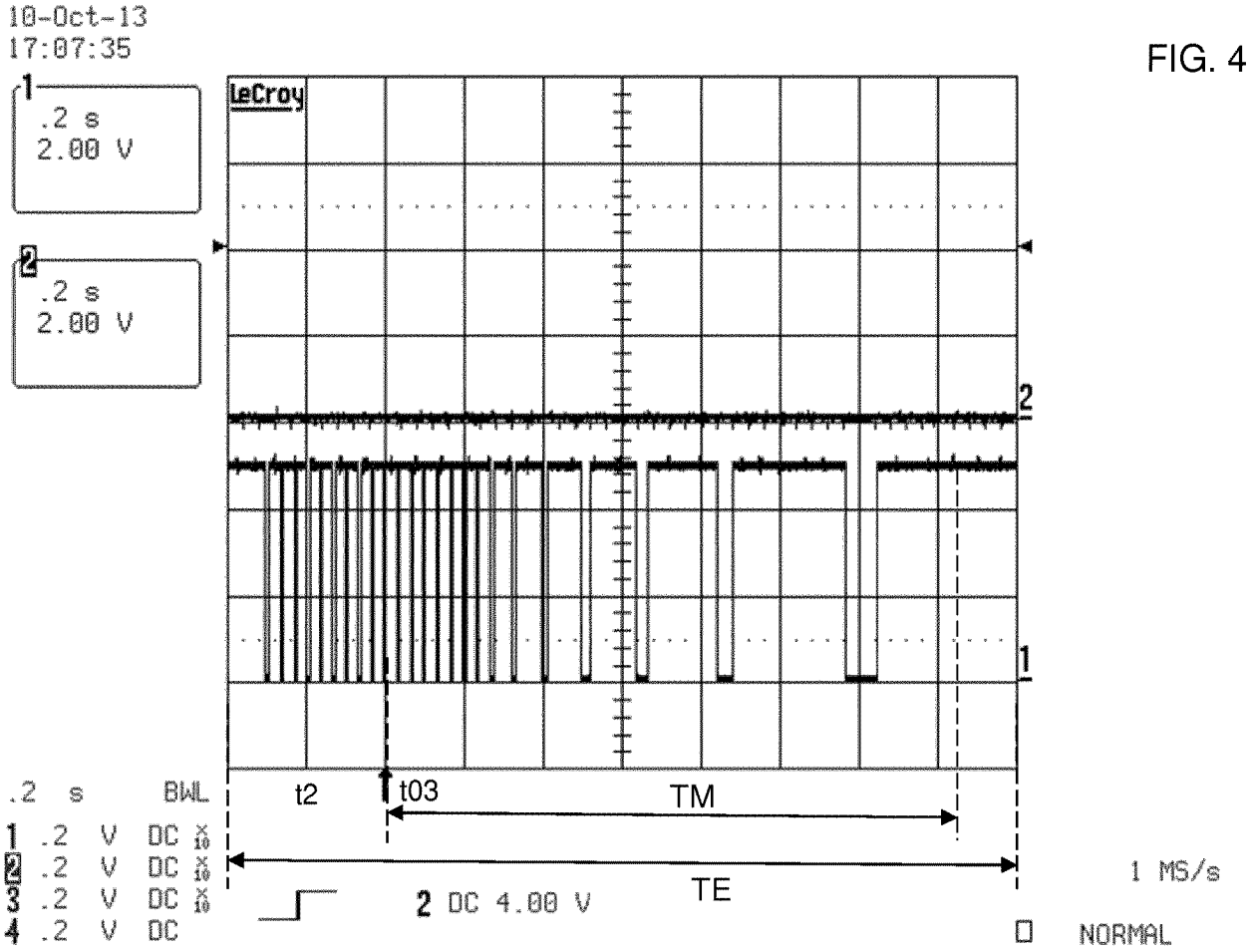
FIG. 4 illustrates the signal generated by a flowmeter as a function of the time according to a preferred embodiment of the invention.

FIG. 4 illustrates the signal generated by a flowmeter as a function of the time according to a preferred embodiment of the invention.

Said signal is detected by the control unit 130 and is used for the calculation of the amount of water flowing in the flowmeter, as better described below.

The flowmeter here described is advantageously a pulse output flowmeter which generates 250 digital pulses when one liter of liquid (water) flows through it or, in other words, a pulse is generated when 4 ml of liquid (water) flows through it (4 ml=1 l/250).

FIG. 4 illustrates the pulses generated by the flowmeter in a particular time interval TE during the washing cycle (the time interval TE is also depicted in FIG. 3). In the washing cycle here illustrated the prefixed refilling amount of water Q(n) is set to 0.51.

In particular, as explained above, from time t2 to time t3 a first water refilling phase is performed (n=1). During a time interval (t2÷t03), the first electrovalve 120 is activated and the real amount of water Qr(1) is loaded into the washing tub 110.

During this time interval (t2÷t03) the first flowmeter 125 generates a plurality of pulses (for example 110 pulses which corresponds to 0.44 l of water). At time t03, the first electrovalve 120 is deactivated (switched-off block 265 of FIG. 2).

From time t03 on, according to the invention, the first flowmeter 125 detects the surplus water Qs(1) during the prefixed monitoring time interval TM (block 270). During the monitoring time interval TM the flowmeter generates a plurality of pulses, for example 14 pulses which corresponds to 64 ml of surplus water Qs(1). Such value of surplus water Qs(1)=64 ml is stored in the control unit 130 and is then used for the calculation (block 250) of the real amount of water Qr(2) in the subsequent (second) water refilling phase, i.e. Qr(2)=Q(2)−Qs(1)=0.51−64 ml=0.434 ml.

Advantageously and according to the preferred aspect of the invention above described, the quantity of water introduced into the washing tub 110 is being properly controlled, irrespective of the working features of the dosing device (electrovalve), for example the extent of switch-off delay time, and/or irrespective of variations of the external water supply line condition, for example variations of the water supply pressure.

Still advantageously, the proper control of water introduced into the washing tub enhances the correct determination/evaluation of the amount load (for example in terms of kg), as mentioned above.

Furthermore, advantageously, the proper control of water introduced into the washing tub leads to the correct determination/evaluation of the amount of the detergent which has to be used for washing the laundry in the following steps of the washing cycle.

This enhances the efficiency of the washing cycle (clean effect) and reduces environmental impact.

Still advantageously, the proper control of water introduced into the washing tub leads to the correct determination/evaluation of the heating time of the washing liquid (water and detergent) inside said washing tub in the following steps of the washing cycle.

Figure 5:
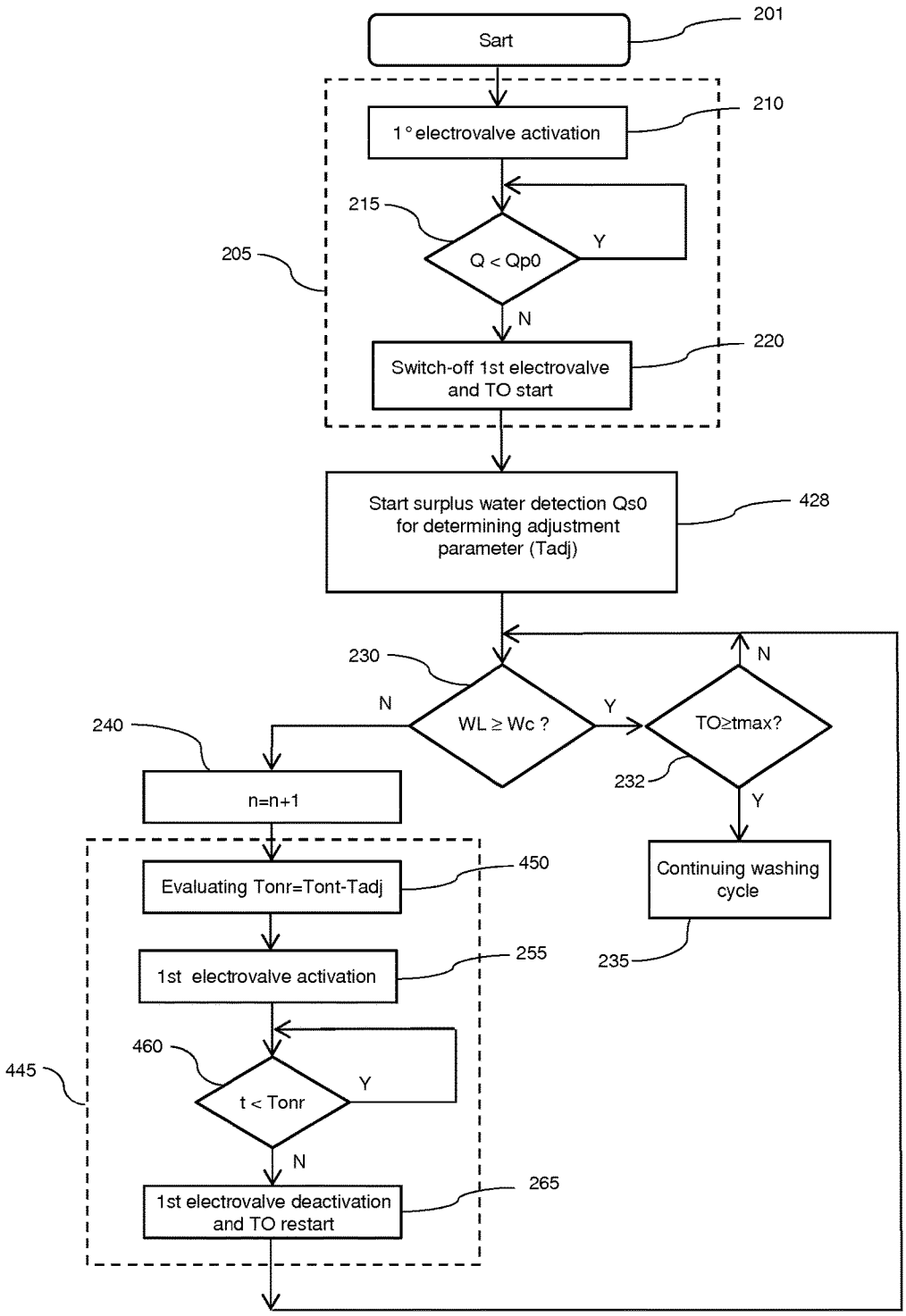
FIG. 5 is a simplified flow chart of the basic operations of the method for operating the washing machine of FIG. 1 according to another preferred embodiment of the invention.

FIG. 5 shows a simplified flow chart of the basic operations of a method for operating the washing machine of FIG. 1 according to another aspect of the invention.

The embodiment of the method here described refers again to a sequence of partial loads of water into the washing tub 110 which are preferably carried out at the beginning of a washing cycle and relates to the phase of the washing cycle where the laundry is being wetted and/or completely drenched.

Again, it is assumed that at the beginning of the cycle the laundry load is already known. In a preferred embodiment, the amount of load may be selected by the user through an interface button or selector, as explained above.

Corresponding blocks of the flow charts of FIGS. 2 and 5 are identified by the same reference numbers.

The method starts at 201. At the beginning, a load of a preliminary fixed amount of water Qp0 into the washing tub 110 (e.g. 6 liters) is performed (block 205); the preliminary fixed amount of water Qp0 to be loaded is preferably a minimum amount of water that would be sufficient for wetting a half laundry load (e.g. 6 liters for a laundry load around 4 kg).

The load of a preliminary fixed amount of water Qp0 (block 205) is carried out by opening the first electrovalve 120. In particular, the loading step (block 205) firstly comprises the electrovalve activation at an initial time t0 (block 210) by sending a switch-on signal from the control unit 130. The water load is controlled by means of the first flowmeter 125 (block 215). When the quantity Q of water detected by the first flowmeter 125 reaches the preliminary fixed amount of water Qp0, at a first time t01 (exit branch "N" of block 215), the first electrovalve 120 is deactivated (block 220) by sending a switch-off signal from the control unit 130.

At the same time a time out timer TO starts to count.

At this point, and according to the preferred aspect of the invention above described, the first flowmeter 125 still continues to detect the water which passes through it (block 428). This means that the first flowmeter 125 detects and/or measures the quantity of water Qs0 which exceeds the preliminary fixed amount of water Qp0 and which is loaded into the washing tub 110, hereinafter indicated as "surplus water" Qs0. The surplus water Qs0 is caused by the delay time of the first electrovalve 120 to close with respect to the time (t01) of the switching-off signal sent by the control unit 130. Due to this delay time, in fact, the water continues to flow through the first electrovalve 120 and the first flowmeter 125, as already explained above. Eventually, the real quantity of water Qr0 loaded into the washing tub 110 is higher than the preliminary fixed amount of water Qp0, i.e. Qr0=Qp0+Qs0.

According to the preferred aspect of the invention here described, the value of the detected surplus water Qs0 is used to take an adjustment action in subsequent activations of the first electrovalve 120 (see block 450 described later). The adjustment action substantially corresponds to a calibration of the first electrovalve 120 in order to solve, or reduce, the problem of the surplus water caused by switching-off delay time of the same first electrovalve 120. At this purpose, the surplus water detection is used to determine a proper adjustment parameter (block 428).

In the preferred embodiment of the method here illustrated (FIG. 5), the adjustment action (block 450) corresponds to the adjustment of the activation time Ton of the first electrovalve 120. In particular, if a theoretical activation time Tont of the first electrovalve 120 is necessary for loading a prefixed amount of refilling water Q(n), for example 0.5 liter, then the real or effective activation time Tonr of the first electrovalve 120 is reduced by an adjustment value Tadj, i.e. Tonr=Tont−Tadj. The adjustment time Tadj is the adjustment parameter determined in said step (block 428) on the base of the detected surplus water Qs0.

For example, if the detected surplus water Qs0 is equal to 0.1 liter, then the adjustment time Tadj is set to is (block 428). If the theoretical activation time Tont necessary to load 0.5 liter is 5 sec, then the real activation time Tonr of the first electrovalve 120 is set to 4 sec, i.e. Tonr=Tont−Tadj=5−1. It is assumed, in fact, that an activation time Ton of the first electrovalve 120 of 4 sec assures a load of 0.5 liter (which includes therefore the surplus water Qs0 flowing through the first electrovalve 120 after its deactivation).

Going back to the operating cycle and as already explained above, after the first electrovalve 120 is deactivated (block 220), substantially at time t01, the level WL of free water present in the washing tub 110 reaches a first level L1. From time t01 on and within a maximum time tmax, the free water level WL is monitored (block 230 and block 232).

In fact, during the subsequent time (t>t1), there will be a first water absorption by the laundry (also in this case water absorption can start already before t1), causing the water level WL to decrease. From time t01 on, the pressure in the washing tub 110, advantageously measured by the pressure switch 169, is monitored; the measured pressure provides an indication of the level WL of free water present in the washing tub 110. The measured pressure is advantageously converted into a measure of the level WL of free water in the washing tub 110, which is compared to a predetermined minimum level Wc (for example, a level of 30 mm) In a further embodiment the measured pressure is compared to a predetermined minimum pressure level Pc (i.e., the pressures are not converted in levels of free water). According to a still further embodiment of the present invention, instead of monitoring the pressure in the washing tub 110, the level WL of free water is directly measured, for example by an optical device or a level sensor, and it is compared to the predetermined minimum level Wc.

If the measured level WL of free water is higher than or equal to the minimum level Wc (exit branch "Y" of block 230), or as long as the measured pressure is higher than or equal to the minimum pressure level Pc, and if the time out timer TO has reached a maximum time out value tmax (exit branch "Y" of block 232), the control unit 130 assesses that the amount of water Qr0 that has been previously loaded in the washing tub 110 is sufficient to guarantee a correct washing of the laundry; in this case, the load of water is considered to be completed, and the washing cycle may continue with the following steps (block 235), e.g. heating, draining, bleaching, spinning, etc.

Conversely (exit branch "N" of block 230), if the measured level WL of free water falls below the minimum level Wc, or if the measured pressure falls below the minimum pressure level Pc, the control unit 130 assesses that the amount of water that has been loaded until now into the washing tub 110 is not sufficient to guarantee a correct washing of the laundry, and further loads of water into the washing tub 110 should be performed (water refilling phases). In the preferred embodiment here described, each of the further water refilling phases consists of a load of a theoretical prefixed amount of refilling water Q(n), for example 0.5 liter. In different embodiments, nevertheless, the amount of refilling water may vary according to preferred ad hoc criteria. The theoretical prefixed amount of refilling water Q(n) corresponds to a theoretical activation time Tont of the first electrovalve 120.

In a successive step (block 240), a refill counter n is incremented. The refill counter n is advantageously set to zero at the beginning of the washing cycle, for example at block 201.

Then, a water refilling phase is performed (block 445). The water refilling phase (block 445) firstly provide for the above mentioned adjustment action (block 450), i.e. the evaluation of the real or effective activation time Tonr of the first electrovalve 120. As explained above, the real or effective activation time Tonr is obtained by subtracting the adjustment parameter Tadj from the theoretical activation time Tont, i.e. Tonr=Tont-Tadj.

After the evaluation step (block 450), water is conveyed into the washing tub 110 by opening the first electrovalve 120 (block 255). In particular, the first electrovalve 120 is activated by sending a switch-on signal from the control unit 130. The water load is controlled by controlling the activation time t of the first electrovalve 120 (block 460). When the activation time t of the first electrovalve 120 reaches the real activation time Tonr (exit branch "N" of block 460), the first electrovalve 120 is deactivated (block 265) by sending a switch-off signal from the control unit 130.

Advantageously, the activation time Ton of the first electrovalve 120 for the real activation time Tonr assures a load of 0.5 liter, or substantially 0.5 liter (which includes therefore the surplus water Qs0 flowing through the first electrovalve 120 after its deactivation).

At the same time the time out timer TO is reset and starts to count.

At this point, the method re-enters the check loop (returning to block 230).

In fact, at the end of the water refilling phase, the level of free water present in the washing tub 110 reaches a new level (L2 or L3 or L4).

During the subsequent time (t>t3 or t>t5 or t>t7), there will be a further water absorption by the laundry, causing the water level WL to decrease. From time t03 or t05 or t07 on and within a maximum time tmax, the pressure in the washing tub 110, advantageously measured by the pressure switch 169, is monitored (as explained above); the measured pressure provides an indication of the level of free water WL present in the washing tub 110. The measured pressure is advantageously converted into a measure of the level of free water WL in the washing tub 110, which is compared to the predetermined minimum level Wc.

The method will proceed, as described above, with one or more further water refilling phase (block 445), if necessary.

Advantageously and according to the preferred aspect of the invention above described, the quantity of water introduced into the washing tub 110 is being properly controlled, irrespective of the working features of the dosing device (electrovalve), for example the extent of the switch-off delay time, and/or irrespective of variations of the external water supply line condition, for example variations of the water supply pressure.

Still advantageously, the proper control of water introduced into the washing tub enhances the correct determination/evaluation of the amount of load, as mentioned above.

Furthermore, advantageously, the proper control of water introduced into the washing tub leads to the correct determination/evaluation of the amount of the detergent which has to be used for washing the laundry in the following steps of the washing cycle.

This enhances the efficiency of the washing cycle (clean effect) and reduces environmental impact.

Still advantageously, the proper control of water introduced into the washing tub leads to the correct determination/evaluation of the heating time of the washing liquid (water and detergent) inside said washing tub in the following steps of the washing cycle.

It has to be noted that in the preferred embodiment of the method here described, the first loading of water, i.e. the load of a preliminary fixed amount of water Qp0 (block 205), is conveyed into the washing tub 110 and used for wetting the laundry. After this loading step (block 205), the surplus water detection and determination of the adjustment parameter (block 428) are performed.

As described above, the detected surplus water Qs0 and the adjustment parameter (block 428) are used to take an adjustment action in activations of the first electrovalve 120 (block 450).

In a further embodiment, nevertheless, the first loading of water may not be conveyed into the washing tub 110.

In this case, the first load of water may be exclusively used for detecting the surplus water and determining the adjustment parameter (block 428), so that in turn said adjustment parameter may be used to take an adjustment action in further activations of the first electrovalve 120.

In this case, preferably, the first load of water may be a small quantity of water.

The first load of water may also be conveyed to an auxiliary container and in case used in a further step of the washing cycle. In a further embodiment, the first load of water may even be expelled to the outside.

Figure 6:
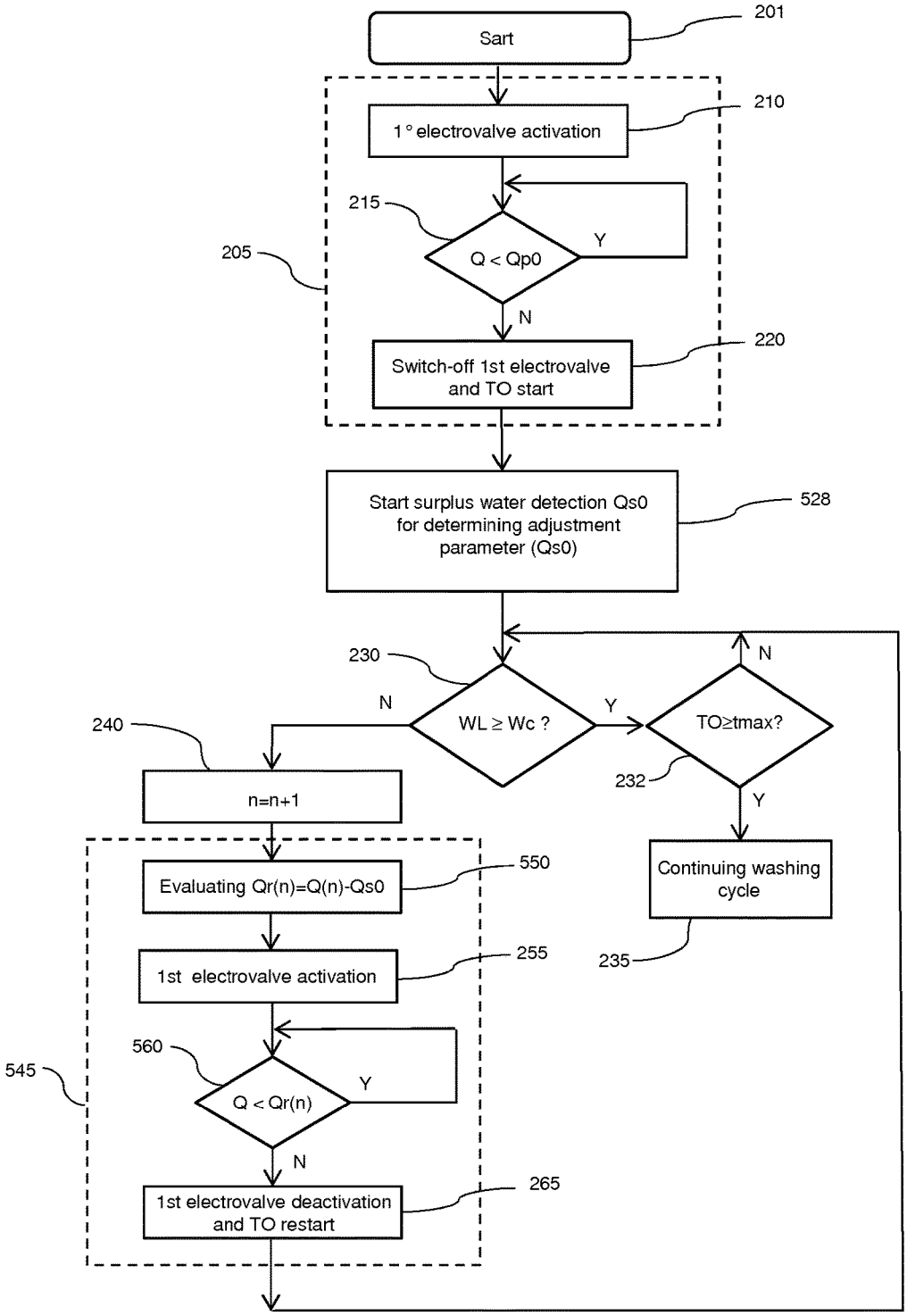
FIG. 6 is a simplified flow chart of the basic operations of a method for operating the washing machine of FIG. 1 according to a further preferred embodiment of the invention.

FIG. 6 shows a simplified flow chart of the basic operations of a method for operating the washing machine of FIG. 1 according to another aspect of the invention.

The embodiment of the method here described refers again to a sequence of partial loads of water into the washing tub 110 which are preferably carried out at the beginning of a washing cycle and relates to the phase of the washing cycle where the laundry is being wetted and/or completely drenched.

Again, it is assumed that at the beginning of the cycle the laundry load is already known. In a preferred embodiment, the amount of load may be selected by the user through an interface button or selector, as explained above.

Corresponding blocks of the flow charts of FIGS. 2 and 6 are identified by the same reference numbers.

The method starts at 201. At the beginning, a load of a preliminary fixed amount of water Qp0 into the washing tub 110 (e.g. 6 liters) is performed (block 205); the preliminary fixed amount of water Qp0 to be loaded is preferably a minimum amount of water that would be sufficient for wetting a half laundry load (e.g. 6 liters for a laundry load around 4 kg).

The load of a preliminary fixed amount of water Qp0 (block 205) is carried out by opening the first electrovalve 120. In particular, the loading step (block 205) firstly comprises the electrovalve activation at an initial time t0 (block 210) by sending a switch-on signal from the control unit 130. The water load is controlled by means of the first flowmeter 125 (block 215). When the quantity Q of water detected by the first flowmeter 125 reaches the preliminary fixed amount of water Qp0, at a first time t01 (exit branch "N" of block 215), the first electrovalve 120 is deactivated (block 220) by sending a switch-off signal from the control unit 130.

At the same time a time out timer TO starts to count.

At this point, and according to the preferred aspect of the invention above described, the first flowmeter 125 still continues to detect the water which passes through it (block 528). This means that the first flowmeter 125 detects and/or measures the quantity of water Qs0 which exceeds the preliminary fixed amount of water Qp0 and which is loaded into the washing tub 110, hereinafter indicated as "surplus water" Qs0. The surplus water Qs0 is caused by the delay time of the first electrovalve 120 to close with respect to the time (t01) of the switching-off signal sent by the control unit 130. Due to this delay time, in fact, the water continues to flow through the first electrovalve 120 and the first flowmeter 125, as already explained above. Eventually, the real quantity of water Qr0 loaded into the washing tub 110 is higher than the preliminary fixed amount of water Qp0, i.e. Qr0=Qp0+Qs0.

According to the preferred aspect of the invention here described, the value of the detected surplus water Qs0 is used to take an adjustment action in subsequent activations of the first electrovalve 120 (see block 550 described later). The adjustment action substantially corresponds to a calibration of the first electrovalve 120 in order to solve, or reduce, the problem of the surplus water caused by switching-off delay time of the same first electrovalve 120. At this purpose, the surplus water detection is used to determine a proper adjustment parameter (block 528).

In the preferred embodiment of the method illustrated in FIG. 6, the adjustment action (block 550) corresponds to the adjustment of the prefixed amount of refilling water Q(n). In particular, if a theoretical prefixed amount of refilling water Q(n) is equal to 0.5 liter, then the real or effective amount of water Qr(n) is reduced by an adjustment value Qs0, i.e. Qr(n)=Q(n)−Qs0. The adjustment value Qs0 corresponds to the surplus water Qs0 determined in said step (block 528).

For example, if the detected surplus water Qs0 is equal to 0.1 liter and the theoretical prefixed amount of refilling water Q(n) is equal to 0.5 liter, then the real or effective amount of water Qr(n) is set to 0.4 liter.

It is assumed, in fact, that the detection by the first flowmeter 125 of an amount of water Qr(n) of 0.4 liter assures a load of 0.5 liter (which includes therefore the surplus water Qs0 flowing through the first electrovalve 120 after its deactivation).

Going back to the washing cycle and as already explained above, after the first electrovalve 120 is deactivated (block 220) substantially at time t01, the level WL of free water present in the washing tub 110 reaches a first level L1. From time t01 on and within a maximum time tmax, the free water level WL is monitored (block 230 and block 232).

In fact, during the subsequent time (t>t1), there will be a first water absorption by the laundry (as already explained, absorption can start also before t1), causing the water level WL to decrease. From time t01 on, the pressure in the washing tub 110, advantageously measured by the pressure switch 169, is monitored; the measured pressure provides an indication of the level WL of free water present in the washing tub 110. The measured pressure is advantageously converted into a measure of the level WL of free water in the washing tub 110, which is compared to a predetermined minimum level Wc (for example, a level of 30 mm) In a further embodiment the measured pressure is compared to a predetermined minimum pressure level Pc (i.e., the pressures are not converted in levels of free water). According to a still further embodiment of the present invention, instead of monitoring the pressure in the washing tub 110, the level WL of free water is directly measured, for example by an optical device or a level sensor, and it is compared to the predetermined minimum level Wc.

If the measured level WL of free water is higher than or equal to the minimum level Wc (exit branch "Y" of block 230), or as long as the measured pressure is higher than or equal to the minimum pressure level Pc, and if the time out timer TO has reached a maximum time out value tmax (exit branch "Y" of block 232), the control unit 130 assesses that the amount of water Qr0 that has been previously loaded in the washing tub 110 is sufficient to guarantee a correct washing of the laundry; in this case, the load of water is considered to be completed, and the washing cycle may continue with the following steps (block 235), e.g. heating, draining, bleaching, spinning, etc.

Conversely (exit branch "N" of block 230), if the measured level WL of free water falls below the minimum level Wc, or if the measured pressure falls below the minimum pressure level Pc, the control unit 130 assesses that the amount of water that has been loaded until now into the washing tub 110 is not sufficient to guarantee a correct washing of the laundry, and further loads of water into the washing tub 110 should be performed (water refilling phases). In the preferred embodiment here described, each of the further water refilling phases consists of a load of a theoretical prefixed amount of refilling water Q(n), for example 0.5 liter. In different embodiments, the amount of refilling water may vary according to preferred ad hoc criteria. The theoretical prefixed amount of refilling water Q(n) corresponds to a theoretical activation time Tont of the first electrovalve 120.

In a successive step (block 240), a refill counter n is incremented. The refill counter n is advantageously set to zero at the beginning of the washing cycle (for example at block 201).

Then, a water refilling phase is performed (block 545). The water refilling phase (block 545) firstly provide for the above mentioned adjustment action (block 550), i.e. the evaluation of the real or effective amount of water Qr(n). As explained above, the real or effective amount of water Qr(n) is obtained by subtracting the adjustment parameter Qs0 from the theoretical prefixed amount of refilling water Q(n), i.e. Qr(n)=Q(n)−Qs0.

After the evaluation step (block 550), water is conveyed into the washing tub 110 by opening the first electrovalve 120 (block 255). In particular, the first electrovalve 120 is activated by sending a switch-on signal from the control unit 130. The water load Q is controlled by means of the first flowmeter 125 (block 560). When the quantity of water Q detected by the first flowmeter 125 reaches the real amount of water Qr(n) (exit branch "N" of block 560), the first electrovalve 120 is deactivated (block 265) by sending a switch-off signal from the control unit 130.

At the same time the time out timer TO is reset and starts to count.

At this point, the method re-enters the check loop (returning to block 230).

In fact, at the end of the water refilling phase, the level of free water present in the washing tub 110 reaches a new level (L2 or L3 or L4).

During the subsequent time (t>t3 or t>t5 or t>t7), there will be a further water absorption by the laundry, causing the water level WL to decrease. From time t03 or t05 or t07 on and within a maximum time tmax, the pressure in the washing tub 110, advantageously measured by the pressure switch 169, is monitored (as explained above); the measured pressure provides an indication of the level of free water WL present in the washing tub 110. The measured pressure is advantageously converted into a measure of the level of free water WL in the washing tub 110, which is compared to the predetermined minimum level Wc.

The method will proceed, as described above, with one or more further water refilling phase (block 545), if necessary.

Advantageously and according to the preferred aspect of the invention above described, the quantity of water introduced into the washing tub 110 is being properly controlled, irrespective of the working features of the dosing device (electrovalve), for example the extent of the switch-off delay time, and/or irrespective of variations of the external water supply line condition, for example variations of the water supply pressure.

Still advantageously, the proper control of water introduced into the washing tub enhances the correct determination/evaluation of the amount of load, as mentioned above.

Furthermore, advantageously, the proper control of water introduced into the washing tub leads to the correct determination/evaluation of the amount of the detergent which has to be used for washing the laundry in the following steps of the washing cycle.

This enhances the efficiency of the washing cycle (clean effect) and reduces environmental impact.

Still advantageously, the proper control of water introduced into the washing tub leads to the correct determination/evaluation of the heating time of the washing liquid (water and detergent) inside said washing tub in the following steps of the washing cycle.

It has to be noted that in the preferred embodiment of the method here described, the first loading of water, i.e. the load of a preliminary fixed amount of water Qp0 (block 205), is conveyed into the washing tub 110 and used for wetting the laundry. After this loading step (block 205), the surplus water detection and determination of the adjustment parameter (block 528) are performed.

As described above, the detected surplus water Qs0 and the adjustment parameter (block 528) are used to take an adjustment action in further activations of the first electrovalve 120 (block 550).

In a further embodiment, nevertheless, the first loading of water may not be conveyed into the washing tub 110.

In this case, the first load of water may be exclusively used for detecting the surplus water and determining the adjustment parameter (block 528), so that in turn said adjustment parameter may be used to take an adjustment action in further activations of the first electrovalve 120.

In this case, preferably, the first load of water may be a small quantity of water.

The first load of water may also be conveyed to an auxiliary container and in case used in a further step of the washing cycle. In a further embodiment, the first load of water may even be expelled to the outside.

It has to be noted that in the preferred embodiments of the method above described, FIGS. 5 and 6, the adjustment actions (block 450 and block 550, respectively) for the activation of the first electrovalve 120 provides for the calculation of a real value (Tonr and Qr(n), respectively) using the adjustment parameter previously determined (Tadj and Qs0 in block 428 and block 528, respectively).

In particular, the real value (Tonr and Qr(n)) is obtained by subtracting the adjustment parameter (Tadj and Qs0) from a theoretical value (Tont and Q(n)).

Nevertheless, in further preferred embodiments of the invention, the adjustment action for the activation of the first electrovalve may be carried out according to different criteria, advantageously based on the previous surplus water detection.

Figure 7:
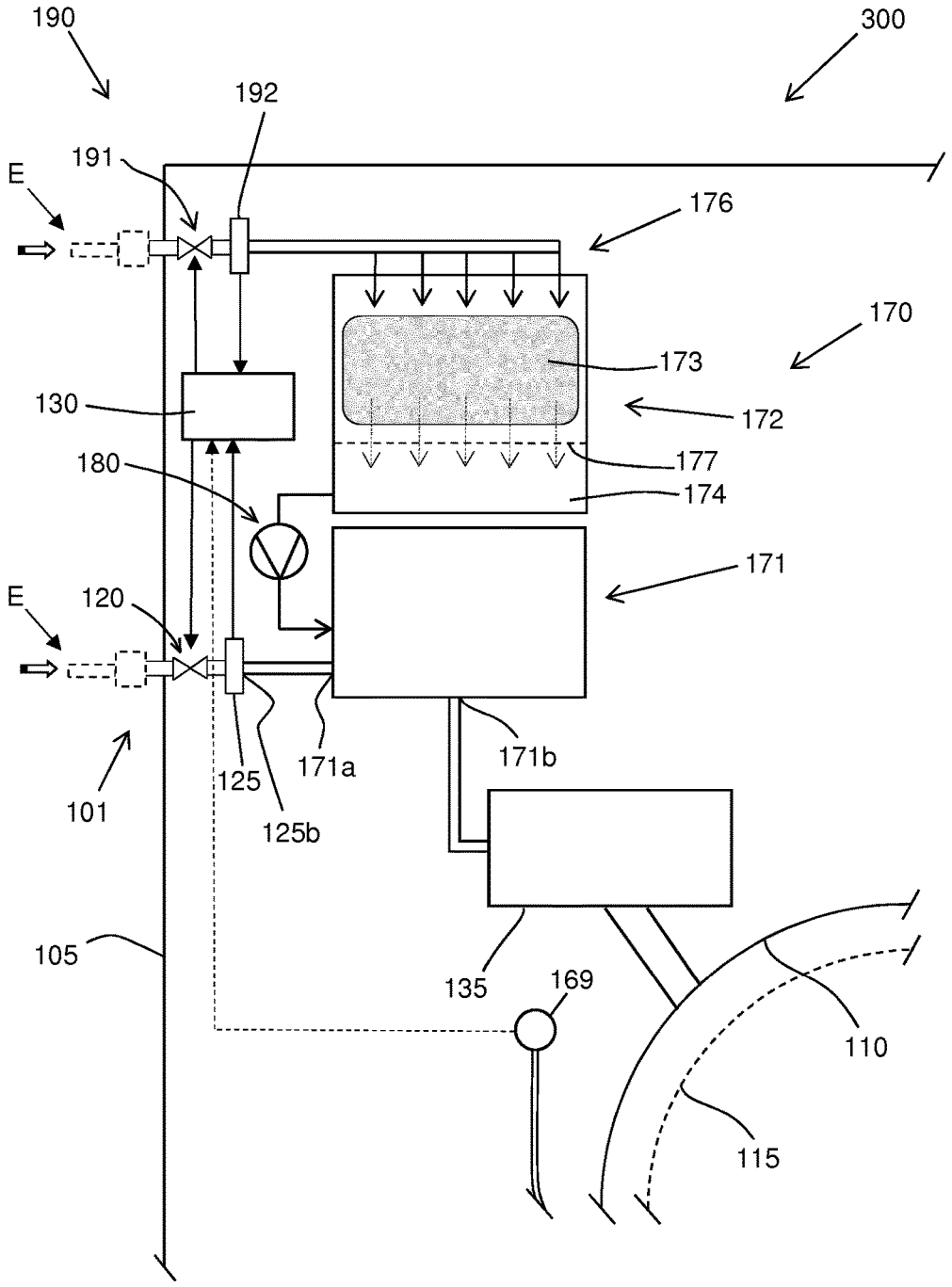
FIG. 7 shows a detail of a further embodiment of the laundry washing machine of FIG. 1 implementing the method according to the invention.

FIG. 7 shows a detail of a laundry washing machine 300 according to a further embodiment of the invention, in which a method according to a further embodiment of the invention is implemented.

The laundry washing machine 300 differs from the laundry washing machine 100 previously described in that it further comprises a water softening device 170, preferably arranged inside cabinet 105.

The water softening device 170 is arranged/interposed between the external water supply line E and the detergent dispensing assembly 135, or container 135, so as to be crossed by the fresh water flowing from the external water supply line E towards the detergent dispensing assembly 135, and is structured for selectively reducing, during each washing cycle, the hardness degree of the fresh water drawn from the external water supply line E and conveyed to the detergent dispensing assembly 135.

In a different embodiment, the water softening device 170 is arranged/interposed between the external water supply line E and the washing tub 110, so as to be crossed by the fresh water flowing from the external water supply line E towards the washing tub 110, and is structured for selectively reducing, during each washing cycle, the hardness degree of the fresh water drawn from the external water supply line E and conveyed directly to the washing tub 110.

The water softening device 170 is opportunely arranged inside the cabinet 105 so that both the detergent dispensing assembly 135 and the water softening device 170 are directly exposed or exposable on the outside of cabinet 105 for being preferably independently accessible by the user at any moment.

The water softening device 170 furthermore basically comprises a water-softening agent container 171 and a regeneration-agent reservoir 172.

The water-softening agent container 171 is crossed by the fresh water arriving from the external water supply line E and passing through the first electrovalve 120 and the first flowmeter 125. The water-softening agent container 171 is filled with a water softening agent able to reduce the hardness degree of the fresh water flowing through the same water-softening agent container 171. More in particular, the water-softening agent container 171 has an inlet 171*a* connected to the first flowmeter outlet 125*b* and an outlet 171*b* connected to the detergent dispensing assembly 135.

The regeneration-agent reservoir 172 instead is fluidly connected to the water-softening agent container 171 and is structured for receiving a given quantity of salt or other regeneration agent which is able to regenerate the water softening function of the water softening agent stored inside the water-softening agent container 171.

Advantageously, the regeneration-agent reservoir 172 of the water softening device 170 is housed inside cabinet 105, preferably with a corresponding independent loading inlet which is exposed or exposable to the outside of the cabinet 105 beside the loading inlet of detergent dispensing assembly 135. This independent loading inlet is suitable for loading the salt or other regeneration agent inside the regeneration-agent reservoir 172.

The water softening device 170 in particular comprises:

the water-softening agent container 171 which is filled with a given amount of ion-exchange resins (not shown) capable to restrain the calcium and/or magnesium ions (Ca++ an Mg++) dissolved in the fresh water flowing across the resin container 171, and which is interposed between the external water supply line E and the detergent dispensing assembly 135; and the regeneration-agent reservoir 172 which is structured for receiving a given amount (for example half a Kilo or one Kilo) of salt grains (Sodium Chloride) or similar regeneration chemical agent.

The ion-exchange resins (not shown) stored into the water-softening agent container 171 form the water softening agent of the water softening device 170.

The water softening device 170 furthermore comprises:

a water load circuit 190 which is structured for channeling, on command, a given amount of fresh water into the regeneration-agent reservoir 172 so to at least partly dissolve the salt or other regeneration agent stored therein and form a given amount of brine (i.e. salt water); and an electrically-powered brine-circulating pump 180 which is interposed between the water-softening agent container 171 and the regeneration-agent reservoir 172 and is structured for transferring/moving the brine (i.e. the salt water) from the regeneration-agent reservoir 172 to the water-softening agent container 171 when activated, and for completely watertight sealing/isolating the regeneration-agent reservoir 172 from the water-softening agent container 171 when deactivated so as to prevent the brine (i.e. the salt water) stored in the regeneration-agent reservoir 172 from flowing towards the water-softening agent container 171.

More specifically, in the example shown the water load circuit 190 is preferably structured for selectively spilling/pouring, on command, a dense shower of water droplets by gravity into the regeneration-agent reservoir 172, so to at least partly dissolve the salt or other regeneration agents stored therein and form a given amount of brine (i.e. salt water).

The water load circuit 190 preferably comprises a second dosing device 191 and a second metering device 192. The second dosing device 191 preferably comprises a second electrovalve 191, whose inlet is connectable (for example via a hose) to the external water supply line E. The second metering device 192 preferably comprises a second flowmeter 192 which is preferably connected to the second dosing device 191 outlet. In different preferred embodiments the metering device may be connected upstream of the dosing device. In a further advantageous embodiment, not illustrated, a single two-ways electrovalve can be provided; the inlet of this electrovalve is connectable (for example via a hose) to an external water supply line, one outlet of the electrovalve is connected to the regeneration-agent reservoir 172, and the second outlet of the electrovalve is connected to the water-softening agent container 171. In this case a single flowmeter can be used, connected between the external water supply line and the inlet of the two-ways electrovalve.

The second electrovalve 191 is preferably controlled by the control unit 130. The control unit 130 also receives the signal generated by the second flowmeter 192.

The regeneration-agent reservoir 172 preferably comprises a salt drawer 173 which is dimensioned for being manually fillable with said given amount of salt grains or other water-softening chemical agents.

The bottom portion of the regeneration-agent reservoir 172 is preferably shaped/structured so as to form a catchment basin 174 wherein the brine accumulates, and the suction of the brine-circulating pump 180 directly communicates with said catchment basin 174 so that the brine-circulating pump 180 is able to selectively pump the brine from the catchment basin 174 to the resin container 171.

Preferably, a porous partition is placed horizontally, such as a filter 177, so as to separate the catchment basin 174 from the upper portion of the regeneration-agent reservoir 172 and to provide a hydraulic connection.

The catchment basin 174 preferably has a fixed volume Vo, for example 250 cc.

The regeneration-agent reservoir 172 and/or the catchment basin 174 can be provided with means for monitoring and/or measuring the level of water and/or salt inside them. In particular the regeneration-agent reservoir 172 and the catchment basin 174 can be provided with corresponding means for monitoring the water level inside them, for example for detecting when the water level inside the catchment basin 174 corresponding to the fixed volume Vo.

The water load circuit 190, as said above, is preferably structured for selectively spilling/pouring, on command, a dense shower of water droplets by gravity into the regeneration-agent reservoir 172, so that as to form the brine directly into the catchment basin 174 of the regeneration-agent reservoir 172.

The water load circuit 190 further preferably comprises:

a sprinkler head 176 which is arranged so as to be located immediately above the salt drawer 173, and it is provided with a shower-making portion/section that preferably, though not necessarily, extends above the whole salt drawer 173, and is structured for feeding a dense shower of water droplets by gravity into the salt drawer 173.

At the activation of the second electrovalve 191, fresh-water is conveyed towards the sprinkler head 176.

The brine-circulating pump 180 of the water softening device 170 preferably comprises a peristaltic pump 180 or other type of volumetric pump specifically structured for transferring/moving the brine (i.e. the salt water) from the regeneration-agent reservoir 172 to the water-softening agent container 171 when activated, and for completely sealing/isolating the regeneration-agent reservoir 172 from the water-softening agent container 171 so as to prevent the brine (i.e. the salt water) store in the regeneration-agent reservoir 172 from flowing towards the water-softening agent container 171.

The brine-circulating pump 180 is preferably activated for a time interval sufficient to transfer/move all the brine from the catchment basin 174 to the water-softening agent container 171, for example to transfer the fixed volume Vo of brine from the catchment basin 174 to the water-softening agent container 171.

The resin container 171, in turn, is preferably, though not necessarily, located inside the cabinet 105, immediately beneath the regeneration-agent reservoir 172 and immediately beside the upper portion of washing tub 110.

In addition to the above, the ion-exchange resins (not shown) are preferably, though not necessarily, confined inside the resin container 171, into a water-permeable basket (not shown) whose volume is less than that of the resin container 171 so as to form an internal peripheral gap or interspace allowing free fresh-water circulation.

Lastly the water softening device 170 is preferably also provided with water-hardness sensor means (not shown) structured to measure the hardness degree of the fresh water coming out from the resin container 171, i.e. the water-softening agent container 171, directed towards the detergent dispensing assembly 135.

In the example shown, in particular, the water-hardness sensor means are able to communicate with the control unit 130.

General operation of the laundry washing machine 300 is clearly inferable from the above description. When the first electrovalve 120 is opened the fresh water flows from the external water supply line E to the resin container 171 of the water softening device 170 wherein the ion-exchange resins reduce the hardness degree of the fresh water directed to the detergent dispensing assembly 135. The water-hardness sensor means monitor the hardness degree of the fresh water directed to the detergent dispensing assembly 135.

After having crossed the resin container 171, the fresh water of the external water supply line E reaches the detergent dispensing assembly 135 and enters into the detergent dispensing assembly 135.

Figure 8:
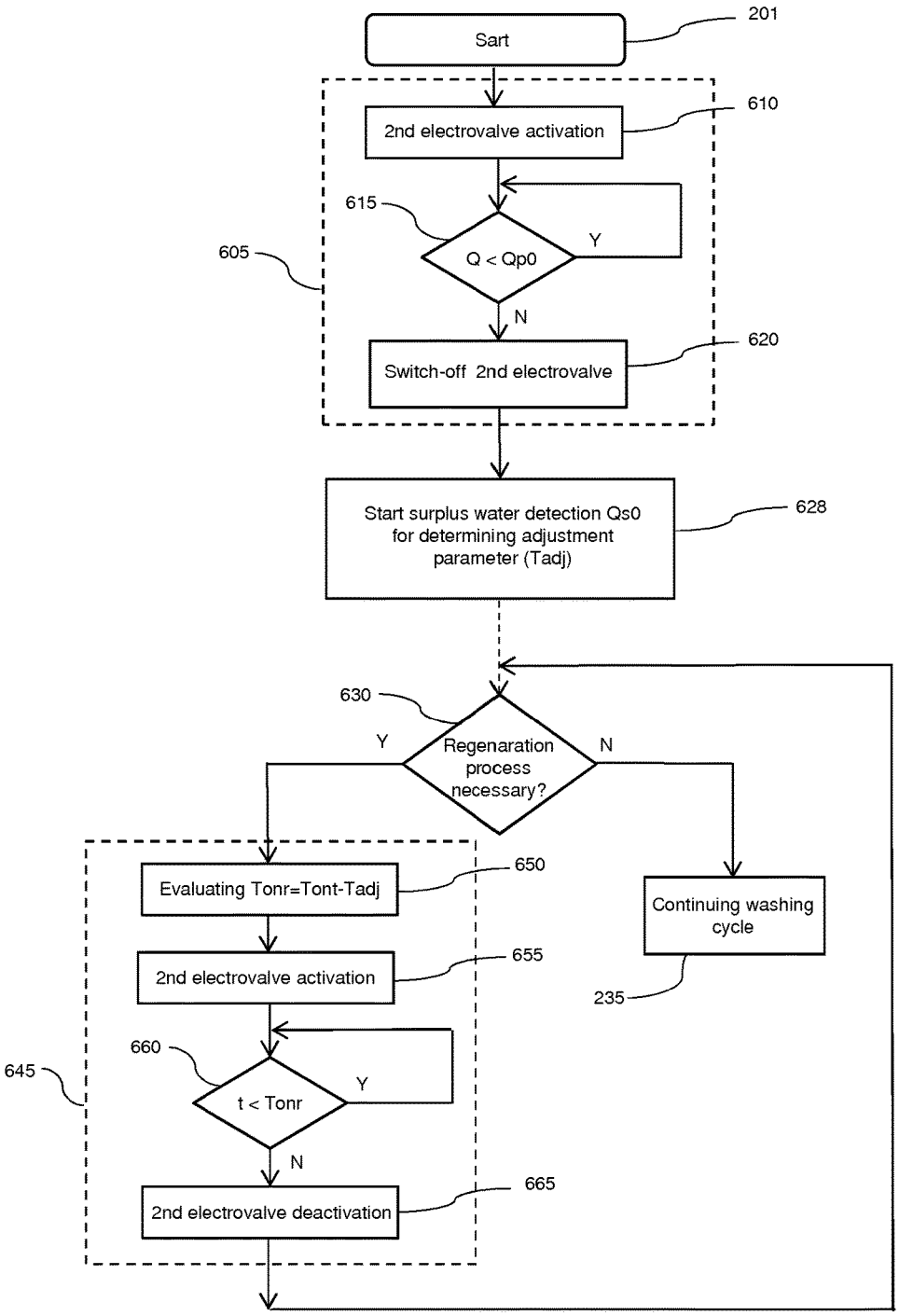
FIG. 8 is a simplified flow chart of the basic operations of a method for operating the washing machine of FIG. 6 according to a preferred embodiment of the invention.

FIG. 8 illustrates in terms of blocks some steps of a method according to an embodiment of the present invention in the laundry washing machine of FIG. 7.

The preferred embodiment of the method here described refers in particular to the regeneration process of the ion-exchange resins stored inside the resin container 171.

The method starts at 201. At the beginning, a load of a preliminary fixed amount of water Qp0 into the regeneration-agent reservoir 172 (e.g. 250 cc) is performed (block 605). The preliminary fixed amount of water Qp0 flows through the regeneration-agent reservoir 172 so that as to form the brine directly into the catchment basin 174 of the regeneration-agent reservoir 172. Therefore, the preliminary fixed amount of water Qp0 to be loaded is preferably the amount of water that would be sufficient to fill up the volume Vo of the catchment basin 174, which is assumed to be empty at the beginning of the washing cycle.

The load of a preliminary fixed amount of water Qp0 (block 605) is carried out by opening the second electrovalve 191 (block 610). In particular, the loading step (block 605) firstly comprises the electrovalve activation (block 610), at an initial time t0, by sending a switch-on signal from the control unit 130. The water load is controlled by means of the second flowmeter 192 (block 615). When the quantity Q of water detected by the second flowmeter 192 reaches the preliminary fixed amount of water Qp0, at a first time t01 (exit branch "N" of block 615), the second electrovalve 191 is deactivated (block 620) by sending a switch-off signal from the control unit 130.

At this point, and according to the preferred aspect of the invention, the second flowmeter 192 still continues to detect the water which passes through it (block 628). This means that the second flowmeter 192 detects and/or measures the quantity of water Qs0 which exceeds the preliminary fixed amount of water Qp0 and which is loaded into the regeneration-agent reservoir 172 and eventually into the catchment basin 174. The quantity of exceeding water Qs0 will be indicated hereinafter as "surplus water" Qs0. The surplus water Qs0 is caused by the delay time of the second electrovalve 192 to close with respect to the time (t01) of the switching-off signal sent by the control unit 130. Due to this delay time, in fact, the water continues to flow through the second electrovalve 191 and the second flowmeter 192. Eventually, the real quantity of water Qr0 loaded into the catchment basin 174 is higher than the preliminary fixed amount of water Qp0, i.e. Qr0=Qp0+Qs0. In a preferred embodiment of the invention, the catchment basin 174 may be preferably provided with an overflow system which drains (to the outside) the water exceeding the volume Vo.

According to the preferred aspect of the invention here described, the value of the detected surplus water Qs0 is used to take an adjustment action in subsequent activations of the second electrovalve 191 (see block 650 described later). The adjustment action substantially corresponds to a calibration of the second electrovalve 191 in order to solve, or reduce, the problem of the surplus water caused by switching-off delay time of the same second electrovalve 191. At this purpose, the surplus water detection is used to determine a proper adjustment parameter (block 628).

In the preferred embodiment of the method here illustrated (FIG. 8), the adjustment action (block 650) corresponds to the adjustment of the activation time Ton of the second electrovalve 191. In particular, if a theoretical activation time Tont of the second electrovalve 191 is necessary for loading a prefixed amount of water Q0, for example 250 cc, then the real or effective activation time Tonr of the second electrovalve 191 is reduced by an adjustment value Tadj, i.e. Tonr=Tont−Tadj. The adjustment time Tadj is the adjustment parameter determined in said step (block 628) on the base of the detected surplus water Qs0.

For example, if the detected surplus water Qs0 is equal to 60 cc, then the adjustment time Tadj is set to 0.5 sec (block 628). If the theoretical activation time Tont necessary to load 250 cc is 1.8 sec, then the real activation time Tonr of the second electrovalve 191 is set to 1.3 sec, i.e. Tonr=Tont−Tadj=1.3−??. It is assumed, in fact, that an activation time Ton of the second electrovalve 191 of 1.3 sec assures a load of 250 cc (which includes therefore the surplus water Qs0 flowing through the second electrovalve 191 after its deactivation).

During the washing cycle, hence, a regeneration process of the ion-exchange resins stored inside the resin container 171 may be necessary (exit branch "Y" of block 630). Conversely (exit branch "N" of block 630), the washing cycle may continue with the following steps (block 235), e.g. heating, draining, bleaching, spinning, etc.

In a preferred embodiment of the invention, request of a regeneration process (exit branch "Y" of block 630) takes place when the ion-exchange resins inside the resin container 171 are no more able to reduce the hardness degree of the fresh water directed to the washing tub 110 via the detergent dispensing assembly 135. This event is preferably detected by the water-hardness sensor means, when provided, which communicate with the control unit 130.

In a further preferred embodiment of the invention, the regeneration process may also take place during pre-wash or rinse phases of the washing cycle. In a still further embodiment the regeneration process may also take place even when no washing cycle at all is running, preferably on specific request of the user.

In a less sophisticated embodiment, however, the control unit 130 of the laundry washing machine 300 may be programmed to regenerate the ion-exchange resins stored in the resin container 171 after a given number of washing cycles. This number of washing cycles may be decided by the user on the basis of an alleged hardness degree of the fresh water coming out from the from the external water supply line E.

Obviously in this less sophisticated embodiment according to the invention, the water-hardness sensor means monitor are unnecessary.

If a regeneration process is necessary (exit branch "Y" of block 630), a water load phase is performed (block 645).

In the preferred embodiment here described, the regeneration process consists of a load of a theoretical prefixed amount of water Q0, for example 250 cc. In different embodiments, the prefixed amount of water Q0 may vary, preferably on the base of the effective volume Vo of the catchment basin 174.

The theoretical prefixed amount of water Q0 corresponds to a theoretical activation time Tont of the second electrovalve 191.

Then, a water load phase is performed (block 645). The water load phase (block 645) firstly provide for the above mentioned adjustment action (block 650), i.e. the evaluation of the real or effective activation time Tonr of the second electrovalve 191. As explained above, the real or effective activation time Tonr is obtained by subtracting the adjustment parameter Tadj from the theoretical activation time Tont, i.e. Tonr=Tont−Tadj.

After the evaluation step (block 650), water is conveyed into the regeneration-agent reservoir 172 so as to form the brine directly into the catchment basin 174 by opening the second electrovalve 191 (block 655). In particular, the second electrovalve 191 is activated by sending a switch-on signal from the control unit 130. The water load is controlled by controlling the activation time t of the second electrovalve 191 (block 660). When the activation time t of the second electrovalve 191 reaches the real activation time Tonr (exit branch "N" of block 660), the second electrovalve 191 is deactivated (block 665) by sending a switch-off signal from the control unit 130.

At this point, the method re-enters the check loop (returning to block 630).

The method will proceed, as described above, with one or more further regeneration processes (block 645), if necessary.

In said load phase (block 645), when the prefixed amount of water Q0 has reached the regeneration-agent reservoir 172, the control unit 130 activates the brine-circulating pump 180 so as to transfer/move the whole brine (i.e. the salt water) from the catchment basin 174 to the resin container 171, i.e. to the water-softening agent container 171. The catchment basin 174 is being emptied.

Then, when the water-softening agent container 171 is completely filled with the brine, the control unit 130 deactivates the brine-circulating pump 180 to watertight sealing the resin container 171 from the regeneration-agent reservoir 172, and to restrain the brine inside the resin container 171 for a predetermined time interval generally sufficient to allow the brine to remove from the ion-exchange resins the calcium and magnesium ions previously combined/fixed to said resins.

Advantageously and according to the preferred aspect of the invention above described, the quantity of water introduced into regeneration-agent reservoir 172 is being properly controlled, irrespective of the working features of the dosing device (electrovalve), for example the extent of the switch-off delay time, and/or irrespective of variations of the external water supply line condition, for example variations of the water supply pressure.

It has to be noted that in the preferred embodiment of the method here described, the first loading of water, i.e. the load of a preliminary fixed amount of water Qp0 (block 605), is conveyed into the regeneration-agent reservoir 172 and used to form the brine into the catchment basin 174. After this loading step (block 605), the surplus water detection and determination of the adjustment parameter (block 628) are performed.

As described above, the detected surplus water Qs0 and the adjustment parameter (block 628) are used to take an adjustment action in further activations of the second electrovalve 191 (block 650).

In a further advantageous embodiment, nevertheless, the first loading of water may not be conveyed into the regeneration-agent reservoir 172.

In this case, the first load of water may be exclusively used for detecting the surplus water and determining the adjustment parameter (block 628), so that in turn said adjustment parameter may be used to take an adjustment action in further activations of the second electrovalve 191.

In this case, preferably, the first load of water may be a small quantity of water.

The first load of water may also be conveyed to an auxiliary container and in case used in a further step of the washing cycle. In a further embodiment, the first load of water may even be expelled to the outside.

Figure 9:
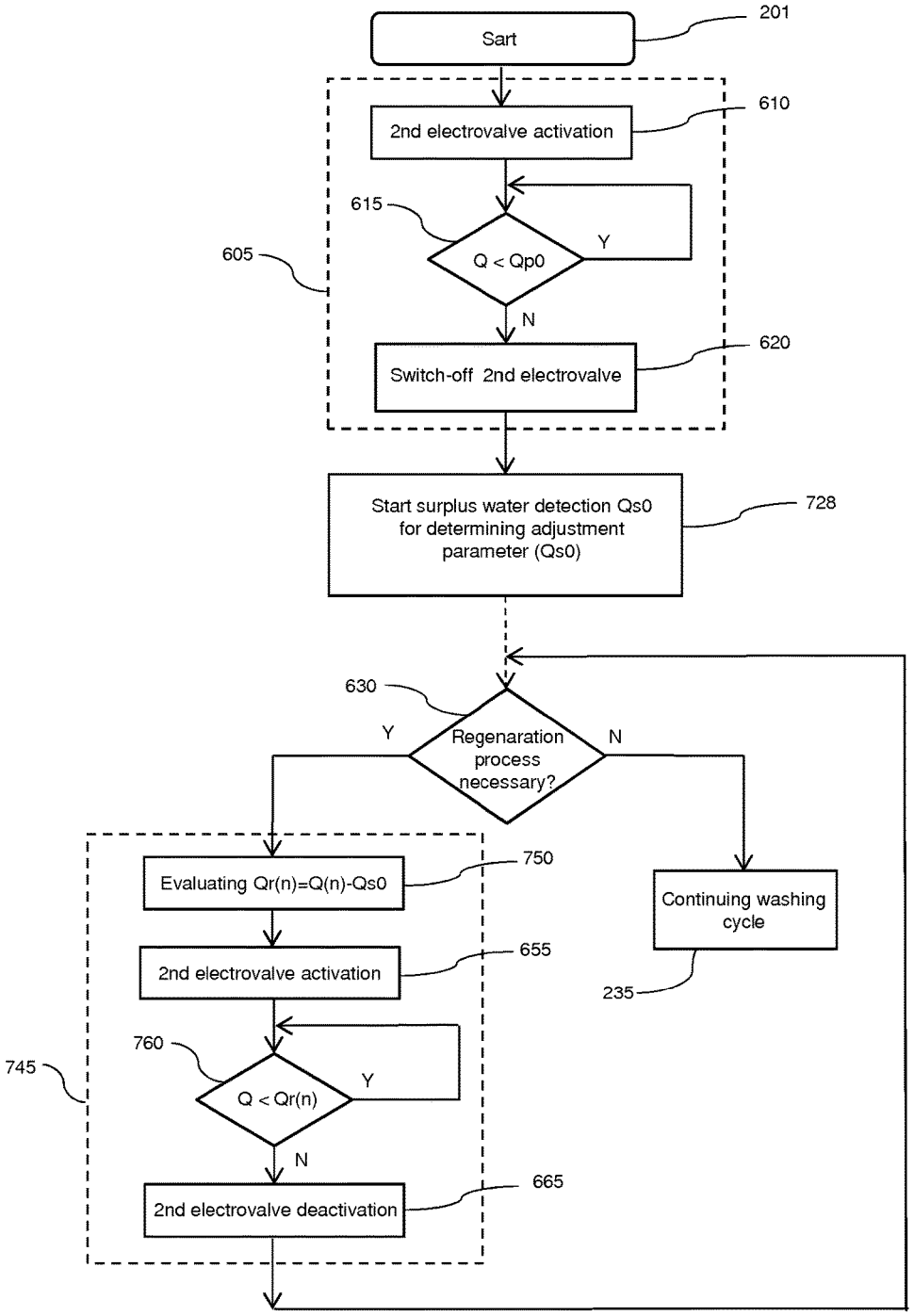
FIG. 9 is a simplified flow chart of the basic operations of a method for operating the washing machine of FIG. 6 according to another preferred embodiment of the invention.

FIG. 9 illustrates in terms of blocks some steps of a method according to another embodiment of the present invention in the laundry washing machine of FIG. 7.

The preferred embodiment of the method here described refers again to the regeneration process of the ion-exchange resins stored inside the resin container 171.

The method starts at 201. At the beginning, a load of a preliminary fixed amount of water Qp0 into the regeneration-agent reservoir 172 (e.g. 250 cc) is performed (block 605). The preliminary fixed amount of water Qp0 flows through the regeneration-agent reservoir 172 so that as to form the brine directly into the catchment basin 174 of the regeneration-agent reservoir 172. Therefore, the preliminary fixed amount of water Qp0 to be loaded is preferably the amount of water that would be sufficient to fill up the volume Vo of the catchment basin 174, which is assumed to be empty at the beginning of the washing cycle.

The load of a preliminary fixed amount of water Qp0 (block 605) is carried out by opening the second electrovalve 191 (block 610). In particular, the loading step (block 605) firstly comprises the electrovalve activation (block 610), at an initial time t0, by sending a switch-on signal from the control unit 130. The water load is controlled by means of the second flowmeter 192 (block 615). When the quantity Q of water detected by the second flowmeter 192 reaches the preliminary fixed amount of water Qp0, at a first time t01 (exit branch "N" of block 615), the second electrovalve 191 is deactivated (block 620) by sending a switch-off signal from the control unit 130.

At this point, and according to the preferred aspect of the invention, the second flowmeter 192 still continues to detect the water which passes through it (block 728). This means that the second flowmeter 192 detects and/or measures the quantity of water Qs0 which exceeds the preliminary fixed amount of water Qp0 and which is loaded into the regeneration-agent reservoir 172 and eventually into the catchment basin 174. The quantity of exceeding water Qs0 will be indicated hereinafter as "surplus water" Qs0. The surplus water Qs0 is caused by the delay time of the second electrovalve 192 to close with respect to the time (t01) of the switching-off signal sent by the control unit 130. Due to this delay time, in fact, the water continues to flow through the second electrovalve 191 and the second flowmeter 192. Eventually, the real quantity of water Qr0 loaded into the catchment basin 174 is higher than the preliminary fixed amount of water Qp0, i.e. Qr0=Qp0+Qs0. In a preferred embodiment of the invention, the catchment basin 174 may be preferably provided with an overflow system which drains (to the outside) the water exceeding the volume Vo.

According to the preferred aspect of the invention here described, the value of the detected surplus water Qs0 is used to take an adjustment action in subsequent activations of the second electrovalve 191 (see block 750 described later). The adjustment action substantially corresponds to a calibration of the second electrovalve 191 in order to solve, or reduce, the problem of the surplus water caused by switching-off delay time of the same second electrovalve 191. At this purpose, the surplus water detection is used to determine a proper adjustment parameter (block 728).

In the preferred embodiment of the method illustrated in FIG. 9, the adjustment action corresponds to the adjustment of the prefixed amount of water Q0 required in a regeneration process. In particular, if a theoretical prefixed amount of water Q0 is equal to 250 cc, then the real or effective amount of water Qr0 is reduced by an adjustment value Qs0, i.e. Qr0=Q0−Qs0. The adjustment value Qs0 corresponds to the surplus water Qs0 determined in said step (block 728).

For example, if the detected surplus water Qs0 is equal to 60 cc and the theoretical prefixed amount of water Q0 is equal 250 cc, then the real or effective amount of water Qr0 is set to 190 cc.

It is assumed, in fact, that the detection by the second flowmeter 192 of an amount of water Qr0 of 190 cc assures a load of 250 cc (which includes therefore the surplus water Qs0 flowing through the second electrovalve 191 after its deactivation).

During the washing cycle, hence, a regeneration process of the ion-exchange resins stored inside the resin container 171 may be necessary (exit branch "Y" of block 630). Conversely (exit branch "N" of block 630), the washing cycle may continue with the following steps (block 235), e.g. heating, draining, bleaching, spinning, etc.

In a preferred embodiment of the invention, request of a regeneration process (exit branch "Y" of block 630) takes place when the ion-exchange resins inside the resin container 171 are no more able to reduce the hardness degree of the fresh water directed to the washing tub 110 via the detergent dispensing assembly 135. This event is preferably detected by the water-hardness sensor means, when provided, which communicate with the control unit 130.

In a further preferred embodiment of the invention, the regeneration process may also take place during pre-wash or rinse phases of the washing cycle. In a still further embodiment the regeneration process may also take place even when no washing cycle at all is running, preferably on specific request of the user.

In a less sophisticated embodiment, however, the control unit 130 of the laundry washing machine 300 may be programmed to regenerate the ion-exchange resins stored in the resin container 171 after a given number of washing cycles. This number of washing cycles may be decided by the user on the basis of an alleged hardness degree of the fresh water coming out from the from the external water supply line E.

Obviously in this less sophisticated embodiment of the invention, the water-hardness sensor means monitor are unnecessary.

If a regeneration process is necessary (exit branch "Y" of block 630), a water load phase is performed (block 745).

In the preferred embodiment here described, the regeneration process consists of a load of a theoretical prefixed amount of water Q0, for example 250 cc. In different embodiments, the prefixed amount of water Q0 may vary, preferably on the base of the effective volume Vo of the catchment basin 174.

The theoretical prefixed amount of water Q0 corresponds to a theoretical activation time Tont of the second electrovalve 191.

Then, a water load phase is performed (block 745). The water load phase (block 745) firstly provide for the above mentioned adjustment action (block 750), i.e. the evaluation of the real or effective amount of water Qr0. As explained above, the real or effective amount of water Qr0 is obtained by subtracting the adjustment parameter Qs0 from the theoretical prefixed amount of water Q0, i.e. Qr(n)=Q(n)−Qs0.

After the evaluation step (block 750), water is conveyed into the regeneration-agent reservoir 172 so as to form the brine directly into the catchment basin 174 by opening the second electrovalve 191 (block 655). In particular, the second electrovalve 191 is activated by sending a switch-on signal from the control unit 130. The water load Q is controlled by means of the second flowmeter 192 (block 760). When the quantity of water Q detected by the second flowmeter 192 reaches the real amount of water Qr0 (exit branch "N" of block 760), the second electrovalve 191 is deactivated (block 665) by sending a switch-off signal from the control unit 130.

At this point, the method re-enters the check loop (returning to block 630).

The method will proceed, as described above, with one or more further regeneration processes (block 745), if necessary.

In said load phase (block 745), when the prefixed amount of water Q0 has reached the regeneration-agent reservoir 172, the control unit 130 activates the brine-circulating pump 180 so as to transfer/move the whole brine (i.e. the salt water) from the catchment basin 174 to the resin container 171, i.e. to the water-softening agent container 171. The catchment basin 174 is being emptied.

Then, when the water-softening agent container 171 is completely filled with the brine, the control unit 30 deactivates the brine-circulating pump 180 to watertight sealing the resin container 171 from the regeneration-agent reservoir 172, and to restrain the brine inside the resin container 171 for a predetermined time interval generally sufficient to allow the brine to remove from the ion-exchange resins the calcium and magnesium ions previously combined/fixed to said resins.

Advantageously and according to the preferred aspect of the invention above described, the quantity of water introduced into regeneration-agent reservoir 172 is being properly controlled, irrespective of the working features of the dosing device (electrovalve), for example the extent of the switch-off delay time, and/or irrespective of variations of the external water supply line condition, for example variations of the water supply pressure.

It has to be noted that in the preferred embodiment of the method here described, the first loading of water, i.e. the load of a preliminary fixed amount of water Qp0 (block 605), is conveyed into the regeneration-agent reservoir 172 and used to form the brine into the catchment basin 174. After this loading step (block 605), the surplus water detection and determination of the adjustment parameter (block 728) are performed.

As described above, the detected surplus water Qs0 and the adjustment parameter are used to take an adjustment action in further activations of the second electrovalve 191 (block 750).

In a further embodiment, nevertheless, the first loading of water may not be conveyed into the regeneration-agent reservoir 172.

In this case, the first load of water may be exclusively used for detecting the surplus water and determining the adjustment parameter (block 728), so that in turn said adjustment parameter may be used to take an adjustment action in further activations of the second electrovalve 191.

In this case, preferably, the first load of water may be a small quantity of water.

The first load of water may also be conveyed to an auxiliary container and in case used in a further step of the washing cycle. In a further embodiment, the first load of water may even be expelled to the outside.

It has to be noted that in the preferred embodiments of the method above described, FIGS. 8 and 9, the adjustment actions (block 650 and block 750, respectively) for the activation of the second electrovalve 191 provides for the calculation of a real value (Tonr and Q(n), respectively) using the adjustment parameter previously determined (Tadj and Qs0 in block 628 and block 728, respectively).

In particular, the real value (Tonr and Q(n)) is obtained by subtracting the adjustment parameter (Tadj and Qs0) from a theoretical value (Tont and Q(n)).

Nevertheless, in further preferred embodiments of the invention, the adjustment action for the activation of the second electrovalve may be carried out according to different criteria, advantageously based on the previous surplus water detection.

For example, the real value (Tonr and Q(n)) for controlling the activation of the second electrovalve may be obtained by multiplying a theoretical value (Tont and Q(n)) to an adjustment coefficient Kadj opportunely determined on the base of surplus water detection (for example Tonr=Tont*Kadj or Qr(n)=Q(n)*Kadj, with Kadj<1).

It has thus been shown that the present invention allows all the set objects to be achieved. In particular, the washing method of the invention makes it possible to properly control the amount of water supplied to the washing machine.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. Method for operating a laundry washing machine, said laundry washing machine comprising:

a washing tub external to a washing drum suited to receive laundry;

a control unit (130);

a water load system suitable to supply water from an external water supply line (E) into a container of said laundry washing machine, said water load system comprising:

a controllable dosing device arranged between said external water supply line (E) and said container and which is activated and deactivated for conveying therethrough an amount of water from said external water supply line (E) to said container;

a metering device arranged between said external water supply line (E) and said container for determining the amount of water flowing through said dosing device;

said method comprising:

a first water conveying step for conveying a first amount of water (Qp0) from said external water supply line (E) through activation and deactivation of said dosing device;

a control step of determining, by means of said metering device, the surplus water flowing through said dosing device after said deactivation of said dosing device in said first water conveying step;

at least a further water conveying step for conveying a further amount of water (Qr(n)) from said external water supply line (E) to said container through activation and deactivation of said dosing device, wherein activation and deactivation of said dosing device in said at least a further water conveying step depends on the amount of said surplus water determined in said control step.

2. The method according to claim 1, wherein said activation and deactivation of said dosing device in said at least a further water conveying step comprises the step of activating said dosing device for an activation time, wherein said activation time depends on the amount of said surplus water determined in said control step.

3. The method according to claim 2, wherein said activation time is obtained by subtracting an adjustment time value based on the amount of said surplus water from a theoretical activation time, wherein said theoretical activation time is the activation time of said dosing device for conveying a further amount of water from said external water supply line (E) to said container.

4. The method according to claim 1, wherein said activation and deactivation of said dosing device in said at least a further water conveying step comprises the step of activating said dosing device by controlling the amount of water flowing therethrough by means of said metering device, wherein said step of controlling the amount of water depends on the amount of said surplus water determined in said control step.

5. The method according to claim 4, wherein said phase of activating said dosing device by controlling the amount of water flowing therethrough by means of said metering device is carried out by subtracting an adjustment amount of water value based on the amount of said surplus water from a theoretical amount of water, wherein said theoretical amount of water is the amount of water flowing through said dosing device for conveying a further amount of water from said external water supply line (E) to said container.

6. The method according to claim 1, wherein said method comprises a plurality of further water conveying steps.

7. The method according to claim 6, wherein each activation and deactivation of said dosing device in said further water conveying steps depends on the amount of said surplus water determined in said control step.

8. The method according to claim 6, wherein the method further comprises a plurality of further control steps of determining, by means of said metering device, the surplus water flowing through said dosing device after each deactivation of said dosing device in said plurality of further water conveying steps.

9. The method according to claim 8, wherein activation and deactivation of said dosing device in one of said further water conveying steps depends on the amount of said surplus water determined in a control step carried out after a preceding water conveying step.

10. The method according to claim 1, wherein said control step of determining, by means of said metering device, the surplus water flowing through said dosing device is carried out for a predetermined time interval after deactivation of said dosing device.

11. The method according to claim 1, wherein said step of determining water flowing through said dosing device by means of said metering device comprises the detection of the amount of water measured by the said metering device or comprises elaboration of a signal generated by said metering device.

12. The method according to claim 1, wherein said container of said laundry washing machine coincides with said washing tub.

13. The method according to claim 12, wherein said first water conveying step and/or said at least a further water conveying step are steps of conveying water into said washing tub for wetting said laundry.

14. The method according to claim 1, wherein said container of said laundry washing machine is a regeneration-agent reservoir of a water softening device of said laundry washing machine.

15. The method according to claim 14, wherein said first water conveying step and/or said at least a further water conveying step are steps of conveying water into said regeneration-agent reservoir for regenerating agent into said regeneration-agent reservoir.

* * * * *